US007376374B2

(12) United States Patent
Adachi

(10) Patent No.: US 7,376,374 B2
(45) Date of Patent: May 20, 2008

(54) DEVELOPMENT APPARATUS AND IMAGE FORMING APPARATUS COMPRISING THE SAME

(75) Inventor: Katsumi Adachi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 309 days.

(21) Appl. No.: 11/334,547

(22) Filed: Jan. 19, 2006

(65) Prior Publication Data

US 2006/0165440 A1 Jul. 27, 2006

(30) Foreign Application Priority Data

Jan. 26, 2005 (JP) ..... 2005-018359

(51) Int. Cl.
*G03G 15/08* (2006.01)

(52) U.S. Cl. ..... 399/254; 399/119; 399/120; 399/260

(58) Field of Classification Search ..... 399/107, 399/110, 116, 120, 252, 254, 255, 260; 222/DIG. 1
See application file for complete search history.

(56) References Cited

U.S. PATENT DOCUMENTS 4,614,165 A 9/1986 Folkins et al.
6,587,661 B1 * 7/2003 Shimmura et al. ..... 399/257
7,257,354 B2 * 8/2007 Schlageter et al. ..... 399/257
7,269,363 B2 * 9/2007 Murata ..... 399/27

FOREIGN PATENT DOCUMENTS

| | | |
|---|---|---|
| JP | 2-21591 | 5/1990 |
| JP | 7-111598 | 11/1995 |
| JP | 10-171248 | 6/1998 |
| JP | 2001-66893 | 3/2001 |
| JP | 2001-265098 | 9/2001 |
| JP | 2005-221852 | 8/2005 |

* cited by examiner

*Primary Examiner*—Hoan Tran
(74) *Attorney, Agent, or Firm*—Nixon & Vanderhye, P.C.

(57) ABSTRACT

A development apparatus according to an embodiment includes a development tank which accommodates developer containing toner and carrier, an agitating screw which agitates and transports the developer in the development tank, and a development roller which is provided close to or in contact with a photosensitive body and visualizes an electrostatic latent image on the photosensitive body. The toner and the carrier are externally replenished to the development tank, and excess developer in the development tank is discharged through a developer discharge outlet to outside of the development container. In the development container, the development apparatus further includes a flow regulating member for regulating a flow of the developer. The flow regulating member is provided facing the developer discharge outlet and extending vertically upward with respect to a bottom plane of the development tank.

15 Claims, 17 Drawing Sheets toner replenishment
developer level
developer discharge
5
11
12
13
13a
14
14a
15
16
17
18
19
20
21
22
23
D4

30
31
21
23
19
11
13a
12
15
14
18
17
13
16
14a
20
developer level 40
41
21
23
19
11
13a
12
15
14
18
17
13
16
14a
20
D72
D71

50
51
21
23
19
11
13a
12
15
14
18
17
13
16
14a
20
11
21
51

60
61
21
19
23
11
13a
12
15
14
18
17
13
16
14a
20
D92
D91
D92
61
21
11

90
91
21
19
11
23
13a
12
15
14
18
17
13
16
14a
20
developer level

DEVELOPMENT APPARATUS AND IMAGE FORMING APPARATUS COMPRISING THE SAME

CROSS REFERENCE TO RELATED APPLICATIONS

This application claims priority under 35 U.S.C. §119(a) on Patent Application No. 2005-18359 filed in Japan on Jan. 26, 2005, the entire contents of which are hereby incorporated by reference.

BACKGROUND OF THE INVENTION

1. Field of Invention

The present invention relates to a development apparatus which is used in an image forming apparatus, such as a copier, a printer, a facsimile machine, or the like, and visualizes an electrostatic latent image formed on an image carrier using developer, and an image forming apparatus comprising the same. More particularly, the present invention relates to a so-called trickle development apparatus which employs two-component developer containing toner and carrier, and supplies the toner and the carrier while discharging excess developer, and an image forming apparatus comprising the same.

2. Related Art

There is a known development apparatus which comprises a development container which accommodates two-component developer containing toner and carrier, an agitating-transport member which agitates and transports the developer in the development container, and a developer carrier which is provided close to or in contact with an image carrier, and visualizes an electrostatic latent image on the image carrier. In such a development apparatus of the two-component development type, a degradation in development performance is caused by a reduction in carrier performance, such as adhesion of the toner to the carrier (so-called "spent phenomenon"), peeling off of carrier coating, or the like.

As means for solving the above-described problems, for example, techniques as disclosed in JP H07-111598 B (hereinafter referred to as "Patent Document 1") and JP H02-21591 B (hereinafter referred to as "Patent Document 2") have been proposed. Patent Documents 1 and 2 disclose a so-called trickle development apparatus. Specifically, in the development apparatus, a small amount of carrier is replenished when replenishing toner, and excess carrier (or developer which is a mixture of carrier and toner) is discharged from a development unit, so that carrier performance is caused to be kept at substantially a constant level in the development unit, thereby stabilizing development performance over time.

As an important operation, for example, such a trickle development apparatus discharges an amount of developer corresponding to the amount of developer (amount of carrier) replenished to the development container, out of the development container, thereby keeping constant the amount of the developer contained in the development container. Here, in the development apparatus described in Patent Documents 1 and 2 discharges developer using a spontaneous discharge method (overflow method) with which the developer is overflowed. Specifically, in a desired state, the bulk of the developer is increased by an amount of developer replenished into the development container, and a portion of the developer located higher than a position of a developer discharge outlet for discharging developer is discharged therethrough. Due to such developer discharge, the amount of the developer in the development container is spontaneously kept constant.

However, a development apparatus which employs a simple overflow method has a drawback such that the height of a developer level in the development container is likely to vary due to external disturbance (e.g., the installed state of the image forming apparatus itself is tilted, an impact is externally applied, etc.), or an operation of agitating the developer in the development container. As a result, the developer is excessively discharged, so that the amount of the developer in the development container is not stable, possibly leading to an adverse influence on development performance of the development apparatus, and further, image formation of the image forming apparatus.

To solve such a problem, there have been various proposals as follows.

For example, a development apparatus has been proposed in which a shutter member is provided on a wall surface of the development container so as to detect a predetermined print amount or the amount of the developer in the development container. Based on a resultant detection signal, the shutter member is opened and closed so as to discharge excess developer.

Also, as disclosed in, for example, JP 2001-265098 A (hereinafter referred to as "Patent Document 3"), a development apparatus has been proposed in which two screw-type agitating members are provided, a developer discharge outlet is formed in a lower portion at a transport direction downstream side of the agitating members, and a member for imparting reverse transport force is provided at a developer discharge outlet side of the agitating member, so that the height of a developer level in the vicinity of the developer discharge outlet is forcedly lowered, whereby, when the developer exceeds a predetermined height of the discharge outlet, the developer is discharged. Although this development apparatus is basically an overflow-type development apparatus, the reverse transport member is provided so as to impart the reverse transport force, thereby preventing a significant change in the height of the developer level in the vicinity of the developer discharge outlet even when the image forming apparatus itself is tilted or an impact is externally applied. As a result, developer discharge can be stably carried out.

However, the above-described conventional development apparatuses have the following problem.

In the trickle development apparatus, the amount of excess developer is considerably small. Therefore, when the development apparatus is provided with a shutter member which is opened and closed so as to discharge excess developer, it is considerably difficult to discharge a considerably small amount of developer with high precision by opening and closing the shutter member. Therefore, in the above-described method, it is considerably difficult to maintain the developer of the development container in a desired amount with high precision.

In the development apparatus disclosed in Patent Document 3, since the developer discharge outlet is provided below the developer level in the development container, developer discharge is significantly affected when a property of the developer in the development apparatus changes. Specifically, when the flowability or bulk density of the developer in the development container is changed due to the environment or a change over time, the flow of the developer is likely to be significantly affected by an operation of the reverse transport member. Therefore, the height of the developer level in the vicinity of the developer discharge outlet may change to a level different from a desired state. When the whole image forming apparatus is tilted in a longitudinal direction of the development apparatus, the reverse transport member effectively works. However, when the whole image forming apparatus is tilted in a direction perpendicular to the longitudinal direction, i.e., a printing direction, the beneficial effect of the reverse transport member is not sufficiently obtained, so that the height of the developer level in the vicinity of the developer discharge outlet may be unstable.

SUMMARY OF THE INVENTION

The present invention is provided to solve the above-described problems. An object of the present invention is to provide a simple and low-cost trickle development apparatus which can stabilize the discharge amount of excess developer and keep developer of a development container in a desired amount with high precision, and an image forming apparatus comprising the same. Another object of the present invention is to provide a trickle development apparatus which can suppress a variation in the height of a developer level due to external disturbance, and prevent excessive developer discharge, and an image forming apparatus comprising the same.

A development apparatus according to the present invention comprises a development container for accommodating developer containing at least toner and carrier, an agitating-transport member for agitating and transporting the developer in the development container, and a developer carrier provided close to or in contact with an image carrier, for visualizing an electrostatic latent image on the image carrier. The toner and the carrier are externally replenished to the development container, and excess developer in the development container is discharged through a developer discharge outlet to outside of the development container. The development apparatus further comprises a flow regulating member for regulating a flow of the developer, the flow regulating member being provided in the development container. The flow regulating member is provided facing the developer discharge outlet and extending vertically upward with respect to a bottom plane of the development container.

According to the development apparatus thus constructed, the flow regulating member regulates and smoothes a flow of the developer in the vicinity of the developer discharge outlet. In addition, it is possible to suppress a variation in a height of the developer level, for example, due to rotation of the agitating-transport member. Thereby, it is possible to stabilize the height of the developer level in the vicinity of the developer discharge outlet, so that the discharge amount of excess developer can be stabilized. As a result, the developer of the development container can be kept in the desired amount with high precision.

In addition, even when the development apparatus is tilted so that the developer discharge outlet is positioned lower and the developer is unevenly distributed in the development container, the flow regulating member blocks the developer surging toward the developer discharge outlet. Therefore, the variation in the height of the developer level in the vicinity of the developer discharge outlet can be suppressed, thereby making it possible to prevent excessive developer discharge. Since the developer is not excessively decreased in the development container, image formation of an image forming apparatus comprising the development apparatus thus constructed is not adversely affected.

In the development apparatus of the present invention, the developer in the development container may be discharged through the developer discharge outlet by overflowing.

When the developer is discharged by opening and closing a shutter member, a mechanism of opening and closing the shutter member, means of detecting the amount of the developer in the development container, control means of driving the shutter based on the detection means, and the like are required. However, according to the development apparatus thus constructed, a simple and low-cost developer discharging mechanism can be achieved.

In the development apparatus of the present invention, the developer discharge outlet may be positioned higher than a developer level which is a reference in the development container. Here, the developer level which is a reference refers to a developer level when a desired amount of developer is accommodated in the development container.

When the developer discharge outlet is provided at a lower portion of the development container and the developer is discharged by opening and closing a shutter member, a mechanism of opening and closing the shutter member, means of detecting the amount of the developer in the development container, control means of driving the shutter based on the detection means, and the like are required. However, according to the development apparatus thus constructed, a simple and low-cost developer discharging mechanism can be achieved.

In the development apparatus of the present invention, the developer discharge outlet and the flow regulating member may be provided downstream in a developer transport direction of the agitating-transport member.

According to the development apparatus thus constructed, when the development apparatus is tilted so that the developer discharge outlet is positioned higher, transport force of the agitating-transport member can suppress the developer from being biased in the tilt direction.

In the development apparatus of the present invention, the developer discharge outlet may be provided on a side wall of the development container.

Depending on the position of the developer discharge outlet, the variation in the height of the developer level may become large due to a rotation operation of the agitating-transport member, so that stable discharge of the developer may be prevented. Therefore, it is preferable that the developer discharge outlet is provided on the side wall of the development container on a downstream side in the developer transport direction.

In the development apparatus of the present invention, a plurality of flow regulating members may be provided in the development container.

According to the development apparatus thus constructed, preferably, when external disturbance is applied (e.g., the whole image forming apparatus is tilted, or an impact is externally applied), uneven distribution of the developer can be reduced by the plurality of flow regulating members, so that the variation in the height of the developer level between the flow regulating member closest to the developer discharge outlet, and the side wall of the development container can be suppressed. Also, even during a normal operation, the function of regulating the flow of the developer in the vicinity of the developer discharge outlet can be improved, thereby making it possible to effectively suppress a temporary variation in the height of the developer level due to rotation of the agitating-transport members, so that developer can be efficiently discharged.

In the development apparatus of the present invention, the flow regulating member which is provided closer to the developer discharge outlet may have a larger length.

According to the development apparatus thus constructed, when the development apparatus is tilted or the like, the plurality of flow regulating members regulate a flow of the developer which otherwise tends to be biased in the tilt direction. Thereby, it is possible to prevent a large amount of developer from flowing into between the flow regulating member closest to the developer discharge outlet, and the side wall of the development container, thereby making it possible to further suppress the variation in the height of the developer level, so that excessive developer discharge can be prevented.

In the development apparatus of the present invention, the flow regulating member may be curved so that a surface on a side opposite to the developer discharge outlet of the flow regulating member is in the shape of a convex toward the developer discharge outlet as viewed from the top.

According to the development apparatus thus constructed, the curved portion of the flow regulating member can prevent an excessive amount of developer from flowing into between the flow regulating member and the side wall of the development container, thereby making it possible to further suppress the variation in the height of the developer level, so that excessive developer discharge can be prevented.

In the development apparatus of the present invention, at least two agitating-transport members may be provided, and a developer transport path formed by the agitating-transport members may be partially separated by a partition wall, and a cut away portion may be formed in an upper portion of an end portion closer to the developer discharge outlet of the partition wall.

According to the development apparatus thus constructed, the flow of the developer takes a shortcut by way of the cut away portion when the development apparatus is tilted or the like. Thereby, it is possible to prevent an excessive amount of developer from flowing into between the flow regulating member and the side wall of the development container, thereby making it possible to further suppress the variation in the height of the developer level, so that excessive developer discharge can be prevented.

In the development apparatus of the present invention, the developer discharge outlet may be positioned facing a connection portion of the developer transport path separated by the partition wall.

Depending on the position of the developer discharge outlet, the variation in the height of the developer level may become large, for example, due to rotation operation of the agitating-transport member, so that stable discharge of the developer may be prevented. In the connection portion of the developer transport path, transport force of the agitating-transport member is attenuated, so that the height of the developer level is relatively readily stabilized. Therefore, as described above, it is preferable that the developer discharge outlet is positioned facing the connection portion of the developer transport path.

In the development apparatus of the present invention, the agitating-transport member may be provided with a member for applying transport force to the developer in the developer transport direction in the connection portion.

According to the development apparatus thus constructed, the transport force in the developer transport direction can be positively applied to the developer flowing the flow regulating member and the side wall of the development container by the above-described member. Thereby, developer discharge can be carried out with high responsiveness, so that stabilization of the height of the developer level can be improved.

In the development apparatus of the present invention, the flow regulating member may have a portion such that a gap between the flow regulating member and the side wall of the development container, the developer discharge outlet being provided on the side wall, is gradually narrowed toward downstream in the developer transport direction.

According to the development apparatus thus constructed, it is difficult for the developer to flow between the flow regulating member and the side wall of the development container, so that the height of the reference developer level becomes higher between the flow regulating member and the side wall of the development container than other portions of the development container. Therefore, when the toner and the carrier are externally replenished to the development container, the amount of the developer in the development container is increased. In this case, even when the developer amount is slightly changed, the variation in the height of the developer level in the vicinity of the developer discharge outlet is significantly amplified. As a result, developer discharge can have good responsiveness.

In the development apparatus of the present invention, a surface closer to the developer discharge outlet of the flow regulating member may protrude toward the developer discharge outlet, and a degree of the protrusion may decrease upward.

According to the development apparatus thus constructed, it is difficult for the developer to flow between the flow regulating member and the side wall of the development container, so that the height of the reference developer level becomes higher than other portions of the development container. Therefore, when the amount of the developer in the development container is increased, the variation in the height of the developer level in the vicinity of the developer discharge outlet is significantly amplified. As a result, developer discharge can have good responsiveness.

In the development apparatus of the present invention, the developer discharge outlet may be provided upstream from a position at which it is most difficult for the developer to flow in a developer transport path between the side wall of the development container on which the developer discharge outlet is provided, and the flow regulating member.

An action which propels the developer in the transport direction and an action which raises the developer are subtly balanced and the height of the developer level is likely to be unstable at a position where the developer has difficulty in flowing, i.e., a position where the gap between the flow regulating member and the side wall of the development container is narrow. Therefore, when the developer discharge outlet is provided in such a position, developer discharge is likely to be unstable. Therefore, it is preferable that the developer discharge outlet is provided at the above-described position, thereby making it possible to achieve stable developer discharge.

An image forming apparatus according to the present invention comprises any of the thus-constructed development apparatuses of the present invention. In other words, the present invention is not limited to the development apparatus, and encompasses an image forming apparatus (a copier, a printer, a facsimile machine, a multifunction machine, etc.) to which the development apparatus of the present invention is applied. According to the image forming apparatus of the present invention, an operational advantage similar to that of the development apparatus of the present invention are obtained.

DESCRIPTION OF THE PREFERRED EMBODIMENTS

Hereinafter, embodiments of the present invention will be described with reference to the accompanying drawings for the purpose of understanding of the present invention. Note that the following embodiments of the present invention are only for illustrative purposes and are not intended to limit the technical scope of the present invention.

Rough Structure of Image Forming Apparatus

Figure 1:
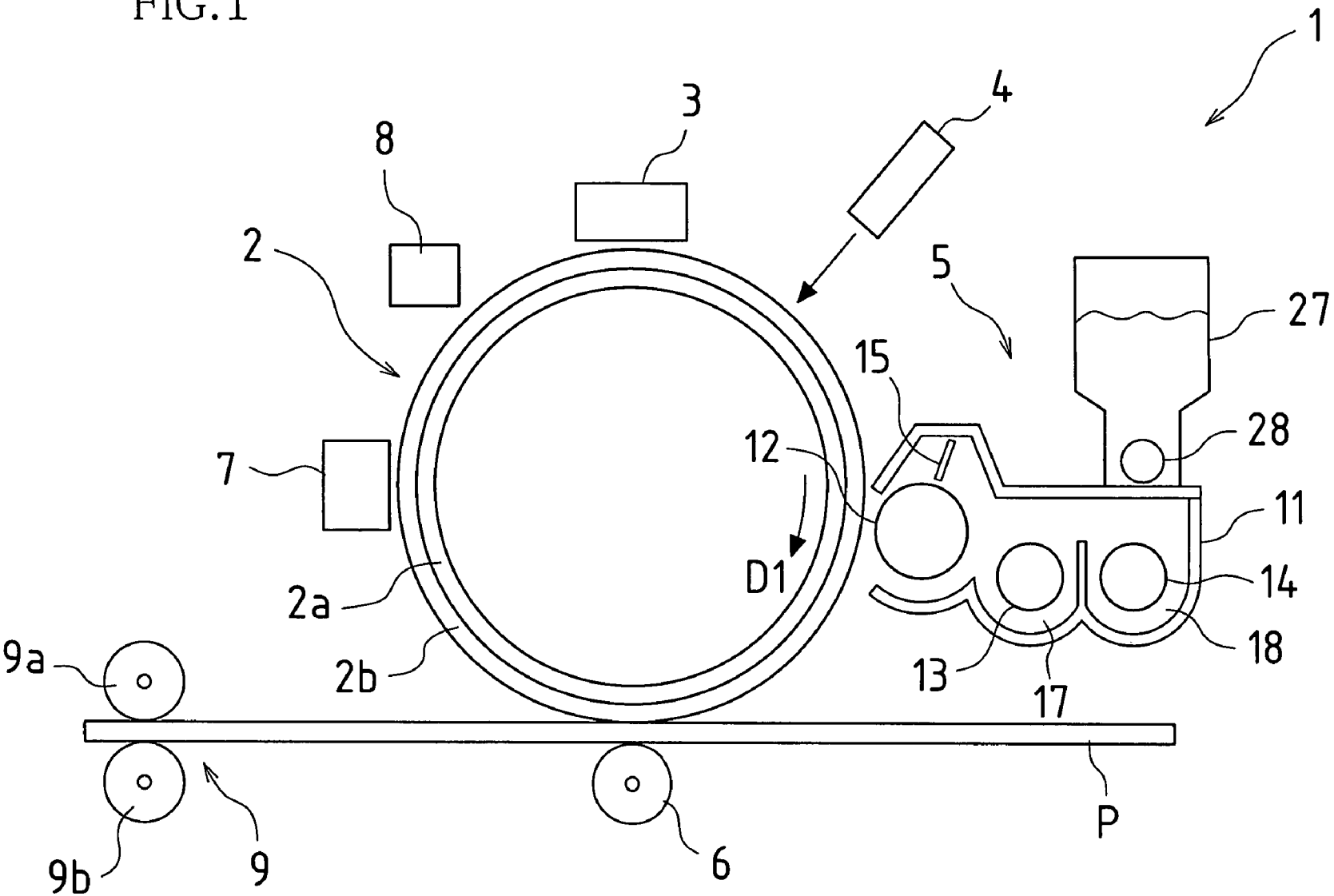
FIG. 1 is a schematic diagram illustrating a rough structure of an image forming apparatus to which a development apparatus according to an embodiment of the present invention is applied.

FIG. 1 is a schematic diagram illustrating a rough structure of an electrophotographic image forming apparatus to which a development apparatus according to an embodiment of the present invention is applied. As illustrated in FIG. 1, the image forming apparatus 1 comprises a photosensitive body 2, a charging member 3, an exposing member 4, a development apparatus 5, a transfer member 6, a cleaning member 7, a charge removal member 8, and a fixing apparatus 9. The charging member 3, the exposing member 4, the development apparatus 5, the transfer member 6, the cleaning member 7, and the charge removal member 8 are provided in this order around the photosensitive body 2 as a center. A paper transport path on which paper P (recording medium) is transported is provided between the photosensitive body 2 and the transfer member 6. The fixing apparatus 9 is provided downstream from the photosensitive body 2, as viewed in a transport direction of the paper transport path.

The photosensitive body 2 is a cylindrical image carrier. The photosensitive body 2 is composed of a base member 2*a*, and a photoconductive layer 2*b* formed thereon. For example, the base member 2*a* is a metal drum made of aluminum or the like, and on an outer circumferential surface thereof, the photoconductive layer 2*b* made of amorphous silicon (a-Si), selenium (Se), an organic photoconductor (OPC), or the like is formed in the shape of a thin film. Note that the structure of the photosensitive body 2 is not particularly limited to the above-described structure.

The charging member 3 uniformly charges the photosensitive body 2. As the charging member 3, for example, a corona charger made of an electric conductor (tungsten wire,.etc.), a metal shield plate, a grid plate, or the like, a charging roller, a charging brush, or the like can be used.

The exposing member 4 writes desired image information as an electrostatic latent image onto the photosensitive body 2 using, for example, laser light. As the exposing member 4, for example, a semiconductor laser, a light emitting diode, or the like can be used.

The development apparatus 5 performs development by adhering developer to the electrostatic latent image on the photosensitive body 2. Details of the development apparatus 5 will be described below.

The transfer member 6 transfers a development image on the photosensitive body 2 to the paper P. As the transfer member 6, for example, a corona transferer, a transfer roller, a transfer brush, or the like can be used.

The cleaning member 7 cleans the photosensitive body 2, i.e., removes a residual developer or paper powder from the photosensitive body 2. As the cleaning member 7, a cleaning blade or the like can be used.

The charge removal member 8 removes residual potential from a surface of the photosensitive body 2. As the charge removal member 8, a charge removal lamp or the like can be used.

The fixing apparatus 9 fixes the development image onto the paper P. The fixing apparatus 9 comprises a pair of fixing rollers 9*a* and 9*b*.

The image forming apparatus 1 forms an electrostatic latent image corresponding to an original image read by an image reading apparatus (not shown) or data from a host computer (not shown), on the photosensitive body 2, develops (visualizes) the electrostatic latent image using the development apparatus 5, and transfers the developed image onto the paper P to perform image formation. Hereinafter, an electrophotographic process of the image forming apparatus 1 will be described in detail.

In the image forming apparatus 1, the photosensitive body 2 can be rotated in a direction D1 illustrated in FIG. 1 from the charging member 3 to each member 4 to 8 in accordance with the order of placement thereof. When a predetermined region of the photosensitive body 2 reaches a position of the charging member 3, the surface of the photosensitive body 2 is charged to a predetermined potential by the charging member 3. Next, the photosensitive body 2 is rotated so that the charged region of the photosensitive body 2 reaches a position of the exposing member 4. The exposing member 4 writes an image onto the surface of the photosensitive body 2 to form an electrostatic latent image.

Thereafter, the photosensitive body 2 is rotated so that a region of the photosensitive body 2 in which the electrostatic latent image is formed reaches a position of the development apparatus 5. The electrostatic latent image on the photosensitive body 2 is developed by the developer of the development apparatus 5 to be visualized as a development image. Next, by rotation of the photosensitive body 2, the region developed by the developer reaches a position of the transfer member 6. The transfer member 6 transfers the development image on the photosensitive body 2 onto the paper P. The development image transferred from the photosensitive body 2 to the paper P is fixed to the paper P by the fixing rollers 9*a* and 9*b* of the fixing apparatus 9.

After transfer of the developer image, the region of the photosensitive body 2 reaches a position of the cleaning member 7 by rotation of the photosensitive body 2. The cleaning member 7 removes residual developer, paper powder, or the like from the photosensitive body 2. Next, after cleaning, the region of the photosensitive body 2 reaches a position of the charge removal member 8 by rotation of the photosensitive body 2. The charge removal member 8 removes residual potential from the photosensitive body 2. The above-described series of operations complete one cycle of image formation. Note that a plurality of pages of paper P are continuously printed by repeating the above-described operations a plurality of times.

Although the image forming apparatus 1 which performs printing using a single color has been described above, an image forming apparatus may be of a tandem type which has development apparatuses and photosensitive bodies corresponding to at least three different colors, or of a three- or four-revolution type which overlays toner images having different colors using a single photosensitive body.

Development Apparatus 5

Next, the development apparatus 5 will be described with reference to FIGS. 2 and 3.

The development apparatus 5 employs developer (two-component developer) containing toner and carrier. FIG. 2 is a top view illustrating an internal structure of the development apparatus 5, and FIG. 3 is a cross-sectional side view thereof. As illustrated in FIGS. 2 and 3, the development apparatus 5 comprises a development tank 11 (as a development container), a development roller 12 (as a developer carrier), two agitating screws 13 and 14 (as agitating-transport members), a partition wall 16, and the like.

The development tank 11 accommodates developer (two-component developer) containing toner and carrier, and supports each member therein. The toner of the developer in the development tank 11 has a weight ratio which is typically set to be several percent. The toner and the carrier are mixed, agitated, and charged in the development tank 11. The carrier can be, for example, a magnetic particle having a surface on which a resin coating layer for imparting chargeableness and suppressing adhesion of the toner is provided. A resin carrier which is a resin particle in which magnetic micropowder is dispersed, or the like can also be used.

The development roller 12 is provided close to or in contact with the photosensitive body 2 (see FIG. 1). The development roller 12 is composed of a magnet roller having a plurality of magnets, and a cylindrical development sleeve which encloses the magnet roller. The magnet roller is supported on both side walls of the development tank 11 in a manner which does not allow the magnet roller to rotate. The development sleeve is rotatably and externally engaged with the magnet roller.

The development roller 12 supplies the toner to the photosensitive body 2 to develop an electrostatic latent image formed on the photosensitive body 2. Specifically, the carrier in the development tank 11 is adsorbed by magnetic force to the development roller 12 (development sleeve), so that a so-called magnetic brush is formed. The carrier is transported by rotation of the development roller 12. The toner adhered to the carrier is supplied to the photosensitive body 2, and is adsorbed to the electrostatic latent image of the photosensitive body 2, resulting in development. Thus, the printing operation of the image forming apparatus 1 consumes the toner in the developer. The toner concentration of the developer in the development tank 11 gradually decreases. Therefore, the development apparatus 5 is provided with a carrier developer replenishment unit (developer replenishment section) 27 which supplies toner to the development tank 11 as described below. Note that a doctor 15 is provided so as to regulate the rising height of the magnetic brush, i.e., the layer thickness of the developer.

The agitating screws 13 and 14 agitate and transport the developer in the development tank 11. The agitating screws 13 and 14 are rotatably supported via respective bearings (not shown) on both the side walls of the development tank 11. By rotation of the agitating screws 13 and 14, a friction occurs between the toner and the carrier, so that the toner is charged. Note that the agitating-transport member is not limited to a screw-shaped member, and may be a paddle-shaped member or the like.

The partition wall 16 is provided between the two agitating screws 13 and 14. The partition wall 16 partially separates a developer transport path formed by the agitating screws 13 and 14. The partition wall 16 divides the developer accommodating portion of the development tank 11 into a first accommodation portion 17 in which the agitating screw 13 is located and a second accommodation portion 18 in which the agitating screw 14 is located. Both the accommodation portions 17 and 18 are in connection with each other via connection portions 19 and 20 which are formed in both side portions of the development tank 11. The partition wall 16 is fixed substantially perpendicular to a bottom plane of the development tank 11, and a top end thereof is positioned higher than at least the height of the developer level in the development tank 11. There are gaps between both side ends of the partition wall 16 and both the side walls of the development tank 11 to form the connection portions 19 and 20. By rotation of the agitating screws 13 and 14, the developer is transported and circulated between the two accommodation portions 17 and 18 as indicated in arrows D2 in FIG. 2. In this case, the developer is transported from one accommodation portion to the other via the connection portions 19 and 20.

Figure 2:
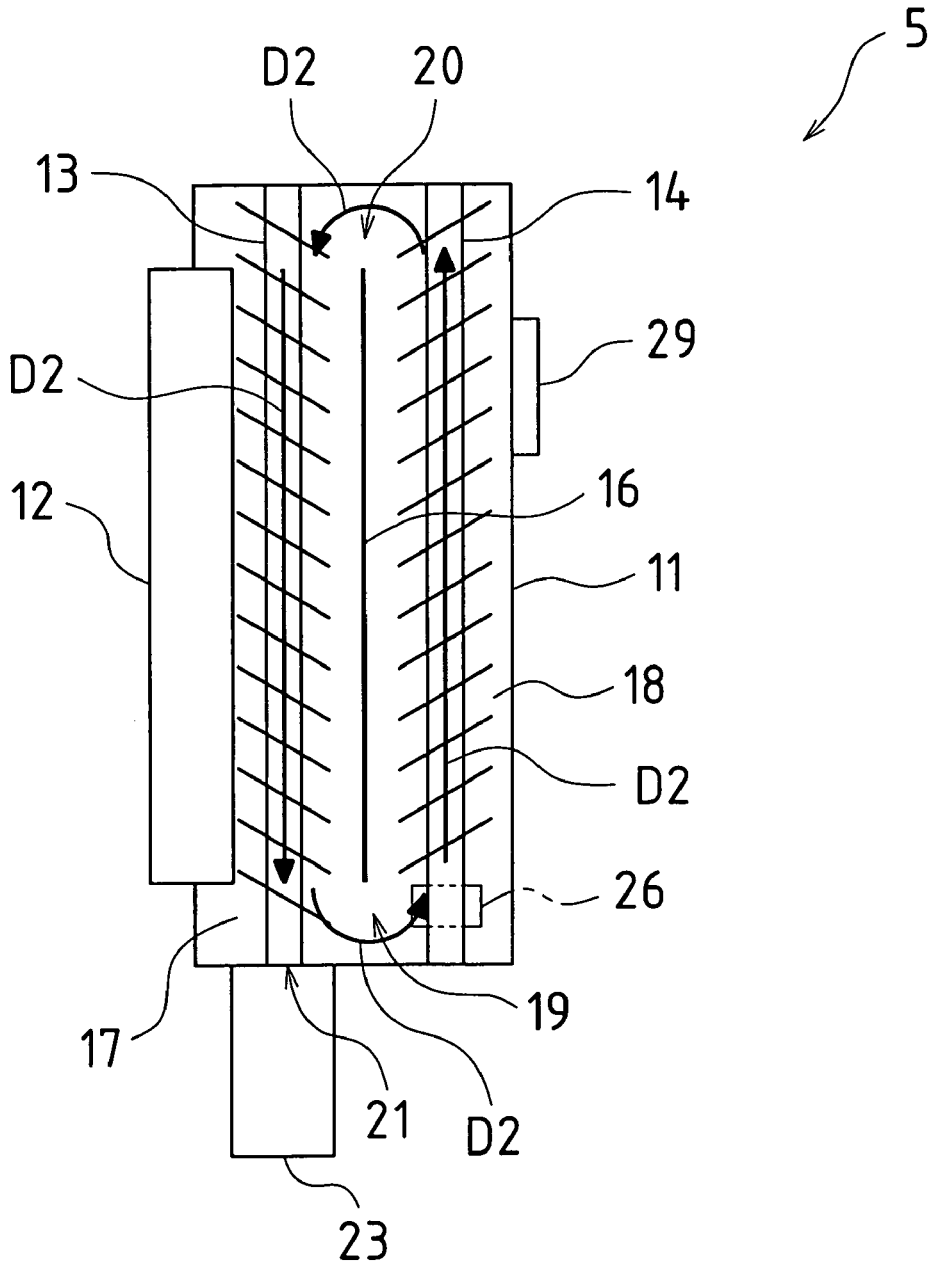
FIG. 2 is a top view illustrating an internal structure of the development apparatus.
Figure 3:
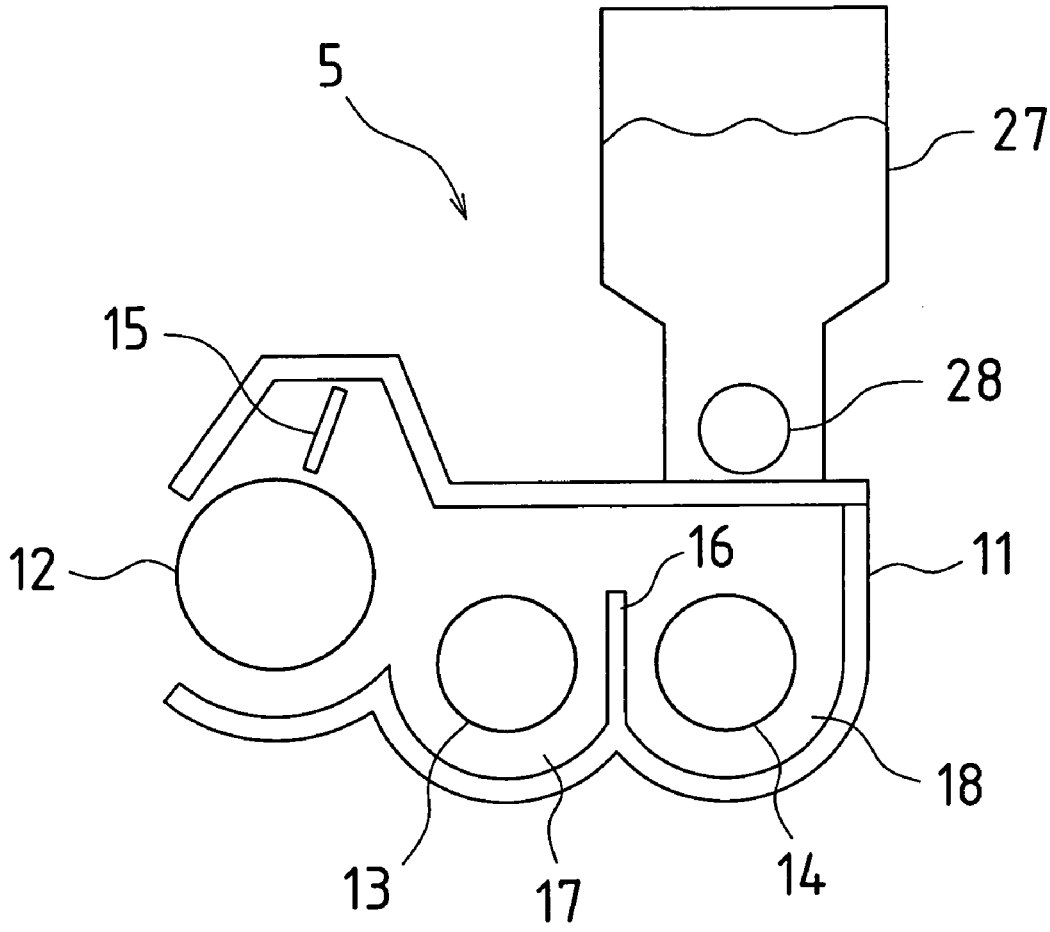
FIG. 3 is a cross-sectional side view of the development apparatus.

A developer discharge outlet 21 for discharging the developer is provided on one of left and right side walls of the development tank 11 (in FIG. 2, the side wall closer to the connection portion 19). A discharge cylinder 23 for discharging the developer into a developer recovery container (not shown) is provided outside the developer discharge outlet 21. The developer overflowing the development tank 11 is discharged through the developer discharge outlet 21 and is recovered through the discharge cylinder 23 into the developer recovery container. Note that the discharge of the developer in the development apparatus 5 will be described below.

A replenishment opening 26 for replenishing developer is formed on an upper wall of the development tank 11. Via the replenishment opening 26, the development tank 11 is in connection with the carrier developer replenishment unit 27 provided above the development tank 11. The carrier developer replenishment unit 27 accommodates developer which is a mixture of carrier and toner in a predetermined ratio (hereinafter referred to as "carrier developer"). The weight ratio of the toner to the carrier developer is set to be about 70 to 95 percent. The carrier developer can be supplied through the replenishment opening 26 into the development tank 11 (the second accommodation portion 18).

A carrier developer replenishment roller 28 which is driven and rotated by a control apparatus (not shown) is provided in a lower portion of the carrier developer replenishment unit 27. By rotation of the carrier developer replenishment roller 28, an amount of the carrier developer which corresponds to a time for which the carrier developer replenishment roller 28 is driven, flows down and is supplied through the replenishment opening 26 into the development tank 11. Here, a toner concentration sensor 29 which detects a toner concentration of the developer in the development tank 11 is provided in the development tank 11. When a detection signal is output from the toner concentration sensor 29 to the control apparatus, the carrier developer replenishment roller 28 of the carrier developer replenishment unit 27 is driven and rotated based on the detection signal, so that the carrier developer is supplied to the development tank 11 as described above.

In this manner, the toner and a considerably small amount of the carrier are supplied to the development tank 11. The carrier developer supplied from the carrier developer replenishment unit 27 is mixed and agitated with the developer which is already present in the development tank 11 by rotation of the agitating screws 13 and 14. Note that the toner concentration sensor 29 includes a magnetic permeability sensor, and detects the magnetic permeability of the developer transported in the development tank 11 by contacting the developer. The ratio of the toner to the carrier is calculated from the magnetic permeability thus detected. The higher the toner ratio, the smaller the amount of the carrier in the developer in contact with the toner concentration sensor 29. Conversely, the higher the carrier amount, the lower the toner ratio.

Discharge of Developer in Development Apparatus 5

Figure 4:
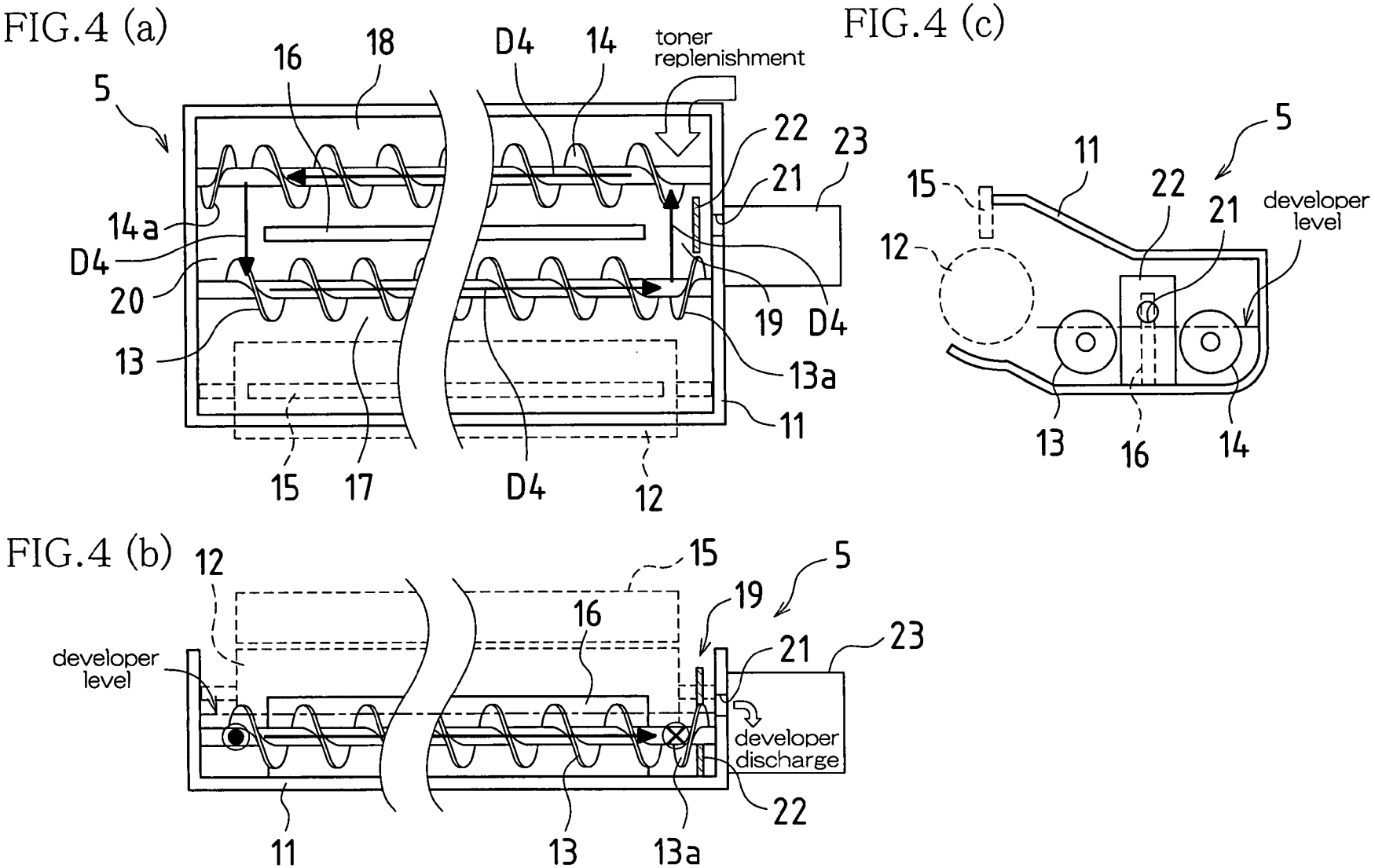
FIGS. 4(*a*) to 4(*c*) are diagrams illustrating developer discharge in the development apparatus.

Next, the discharge of the developer in the development apparatus 5 will be described in detail with reference to FIGS. 4(*a*) to 5(*d*). FIGS. 4(*a*) to 4(*c*) are diagrams illustrating the discharge of the developer in the development apparatus 5. FIG. 4(*a*) is a top view, FIG. 4(*b*) is a front view, and FIG. 4(*c*) is a side view.

As described above, the development apparatus 5 is a so-called trickle development apparatus. In the development apparatus 5, the two agitating screws 13 and 14 of screw type are provided as developer agitating-transport members, and the partition wall 16 is provided between the agitating screws 13 and 14 so that the respective agitation regions are formed. In the development apparatus 5, by rotation of the agitating screws 13 and 14, the developer is mixed, agitated, transported, and charged in the development tank 11. The printing operation of the image forming apparatus 1 consumes the toner of the developer, and when the toner concentration of the developer in the development tank 11 decreases, the carrier developer is replenished to the development tank 11 by the carrier developer replenishment unit 27.

As illustrated in FIGS. 4(*a*) and 4(*b*), reverse pitch blade members 13*a* and 14*a* are attached to downstream portions of the agitating screws 13 and 14, respectively, as viewed in the developer transport direction (indicated with arrows D4 in FIG. 4(*a*)) in the development tank 11. By means of the blade members 13*a* and 14*a*, the developer which has been transported to downstream sides in the developer transport direction of the agitating screws 13 and 14 is suppressed from being squeezed into the bearing portions which support the agitating screws 13 and 14 on the side walls of the development tank 11. Thereby, operation states of the bearing portions of the agitating screws 13 and 14 are prevented from being deteriorated, so that rotation operations of the agitating screws 13 and 14 are kept smooth.

The developer discharge outlet 21 for discharging excess developer is formed on the side wall of the development tank 11 which is located at a downstream side in the developer transport direction of the agitating screw 13 which is closer to the development roller 12. The developer discharge outlet 21 is provided at a position which faces the connection portion 19. A lower end of the developer discharge outlet 21 is positioned at a height substantially equal to or slightly higher than the height of the developer level (when a desired amount of developer is accommodated) which serves as a reference in the development tank 11. As described above, when the carrier developer is replenished from the carrier developer replenishment unit 27 to the development tank 11, the amount of the developer in the development tank 11 increases, so that the developer level is raised. In this case, if the developer level is higher than the developer level reference height, the developer is discharged through the developer discharge outlet 21 by overflowing, and is recovered through the discharge cylinder 23 into the developer recovery container (not shown). In other words, when the height of the developer level in the development tank 11 exceeds the height of the lower end of the developer discharge outlet 21, an amount of excess developer corresponding to the excess height is discharged through the developer discharge outlet 21 by overflowing. In this manner, the height of the developer level is kept constant. In other words, the developer of the development tank 11 is kept in the desired amount. Note that, as means of discharging the developer in the discharge cylinder 23, means of forcedly transporting and discharging the developer using a screw-type member, means of tilting the bottom plane outward and downward so as to cause the developer to be spontaneously discharged, or the like can be used.

A flow regulating member (flow regulating plate) 22 which regulates a flow of the developer in the vicinity of the developer discharge outlet 21 is provided closer to the developer discharge outlet 21 of the development tank 11. The flow regulating member 22 is opposed to the developer discharge outlet 21. Specifically, the flow regulating member 22 is provided in the connection portion 19 between the partition wall 16 and the side wall of the development tank 11. The flow regulating member 22 is an erected wall-shaped member which extends vertically upward from the bottom plane of the development tank 11, and is provided substantially parallel to the side wall of the development tank 11. A top end of the flow regulating member 22 is positioned at a height higher than a top end of the developer discharge outlet 21. The flow regulating member 22 has a length in a direction along the side wall of the development tank 11, which is as long as possible within a range in which the flow regulating member 22 does not interfere with the agitating screws 13 and 14.

During a normal printing operation of the image forming apparatus 1, the developer in the development tank 11 is agitated and transported by the agitating screws 13 and 14. In this case, most of the developer transported in the connection portion 19 flows between the partition wall 16 and the flow regulating member 22, and a remaining portion thereof flows between the flow regulating member 22 and the side wall of the development tank 11. When the carrier developer is replenished from the carrier developer replenishment unit 27, the amount of the developer in the development tank 11 increases, the developer level between the flow regulating member 22 and the side wall of the development tank 11 is raised, so that the developer is discharged through the developer discharge outlet 21. In this case, the flow regulating member 22 regulates and smoothes the flow of the developer in the connection portion 19 (in the vicinity of the developer discharge outlet 21). In addition, it is possible to suppress a variation in the height of the developer level due to the rotation of the agitating screws 13 and 14 or the like. Thereby, it is possible to stabilize the height of the developer level between the flow regulating member 22 and the side wall of the development tank 11, so that the discharge amount of excess developer can be stabilized. As a result, the developer of the development tank 11 can be kept in the desired amount with high precision.

Figure 5:
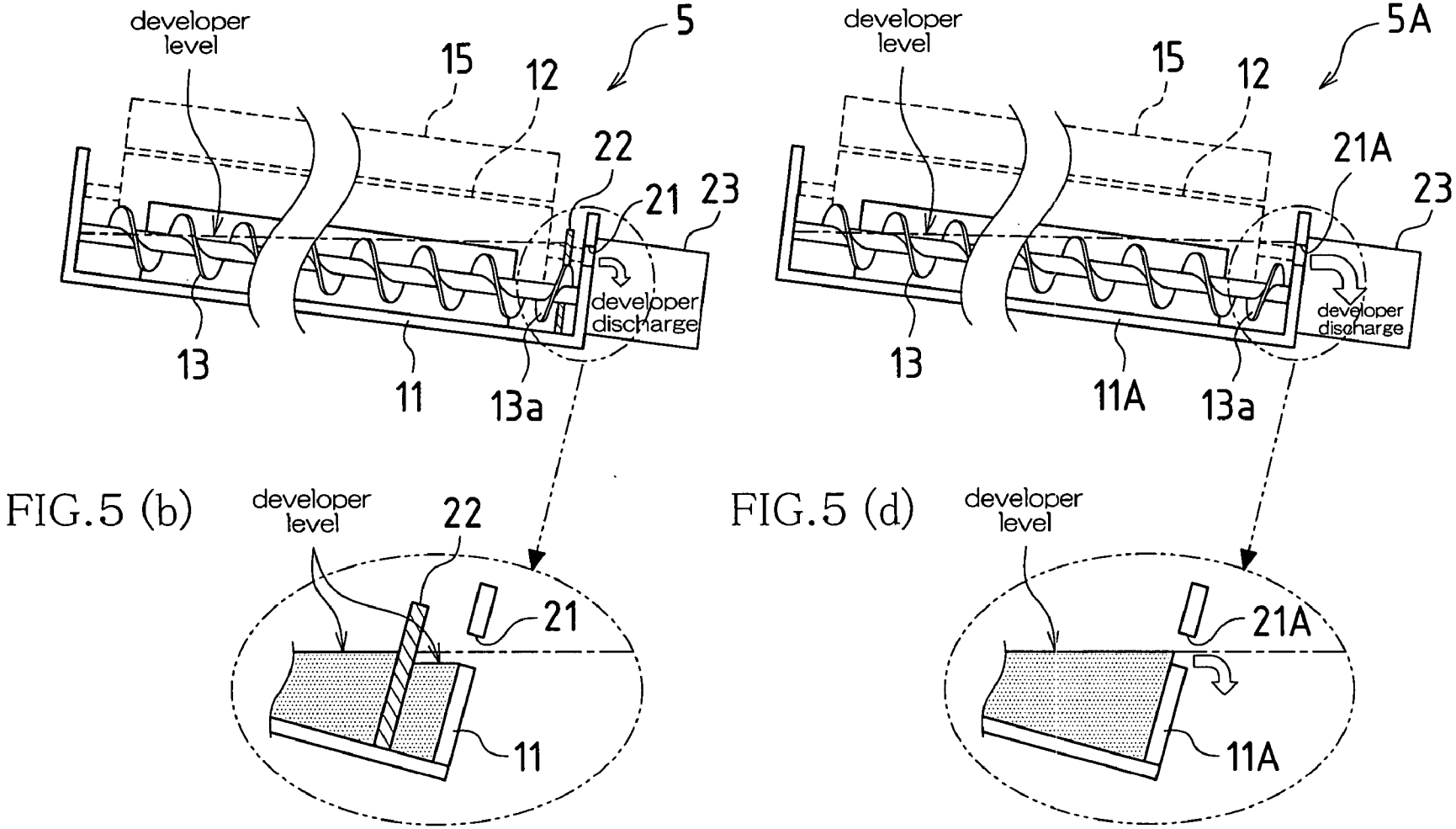
FIGS. 5(*a*) to 5(*d*) are diagrams illustrating developer discharge when the development apparatus is tilted.

On the other hand, except during the normal printing operation, for example, even when external disturbance is applied (e.g., the whole image forming apparatus 1 is tilted or an impact is externally applied), the following beneficial effect is exhibited. FIGS. 5(*a*) to 5(*d*) are diagrams illustrating discharge of the developer when the development apparatus is tilted. FIG. 5(*a*) illustrates the development apparatus 5 provided with the flow regulating member 22, and FIG. 5(*b*) illustrates a main portion thereof. FIG. 5(*c*) illustrates a development apparatus 5A which is not provided with the flow regulating member 22, and FIG. 5(*d*) illustrates a main portion thereof.

In the case of the development apparatus 5A without the flow regulating member, when the development apparatus 5A is tilted to lower a developer discharge outlet 21A, the developer is unevenly distributed in a development tank 11A so that a developer level closer to the developer discharge outlet 21A becomes higher, as illustrated in FIGS. 5(*c*) and 5(*d*). Therefore, even when the desired amount of developer is accommodated in the development tank 11A, unnecessary developer discharge is performed. As a result, the developer in the development tank 11A is decreased, leading to an adverse influence on image formation of the image forming apparatus.

In contrast to this, in the case of the above-described development apparatus 5 with the flow regulating member 22, even when the development apparatus 5 is tilted so that the developer discharge outlet 21 is positioned lower and the developer is unevenly distributed in the development tank 11, the flow regulating member 22 blocks the developer surging toward the developer discharge outlet 21, as illustrated in FIGS. 5(*a*) and 5(*b*). Therefore, the variation in the height of the developer level between the flow regulating member 22 and the side wall of the development tank 11 can be suppressed, thereby making it possible to prevent excessive developer discharge. Since the developer is not excessively decreased in the development tank 11, the image formation of the image forming apparatus 1 is not adversely affected. Similarly, even when an impact is externally applied to the image forming apparatus 1, the variation in the height of the developer level between the flow regulating member 22 and the side wall of the development tank 11 can be suppressed, thereby making it possible to prevent excessive developer discharge.

For example, if the image forming apparatus 1 can print A4 paper in landscape orientation, the development roller 12 of the development apparatus 5 needs to have a longitudinal length of at least 300 mm, and the development tank 11 needs to have a longitudinal length larger than or equal to that length. Here, assuming that a gap between the flow regulating member 22 and the side wall of the development tank 11 is about 2 mm, when the development tank 11 is tilted, a variation in the height of the developer level on an outer side of the flow regulating member 22 (between the flow regulating member 22 and the side wall of the development tank 11) can be suppressed to less than from severalth to several tenths of a variation in the height of the developer level on an inner side of the flow regulating member 22 (between the flow regulating member 22 and the partition wall 16).

In this example, the developer discharge outlet 21 is provided on the side wall of the development tank 11 which is at a downstream side in the developer transport direction of the agitating screw 13 which is closer to the development roller 12, and the flow regulating member 22 is provided in the connection portion 19 closer thereto. Thereby, preferably, the developer is discharged in a sufficiently agitated state, so that the developer having a desired toner concentration can be discharged. Note that the developer discharge outlet 21 may be provided on the side wall of the development tank 11 which is at a downstream side in the developer transport direction of the agitating screw 14 which is farther from the development roller 12, and the flow regulating member 22 may be provided in the connection portion 20 closer thereto. In this case, a similar operational advantage can be exhibited. Alternatively, a developer discharge outlet may be provided on a rear wall of the development tank 11 (a wall farther from the development roller 12), and a flow regulating member may be provided in the vicinity thereof Note that, in this case, a variation in the height of the developer level between the flow regulating member and the rear wall of the development tank may become large by rotation of the flow agitating-transport member, or the developer which is not sufficiently mixed after replenishment of the carrier developer may reach the developer discharge outlet, so that the developer having the desired toner concentration may not be discharged, depending on the shape of the agitating-transport member and the agitating method.

By providing the developer discharge outlet 21 on the side wall of the development tank 11 at the downstream side in the developer transport direction, when the development apparatus 5 is tilted in a direction opposite to that in the case of FIG. 5(*a*), i.e., when the development apparatus 5 is tilted so that the developer discharge outlet 21 is positioned higher, the transport force of the agitating screw 13 can suppress the developer from being biased in the opposite direction. Thus, the development apparatus 5 of this example has a developer discharging mechanism which is robust against external disturbance, and can address both when the development apparatus 5 is tilted toward the developer discharge outlet 21 and when it is tilted in the opposite direction.

Depending on the position of the developer discharge outlet, the variation in the height of the developer level may become large due to the rotation operation of the agitating-transport member or the like, so that stable discharge of the developer is prevented. In the above-described example, the developer discharge outlet 21 is provided at a position of the side wall of the development tank 11, the position facing the connection portion 19. In the connection portions 19 and 20, the transport force of the agitating screws 13 and 14 are attenuated, so that the height of the developer level is relatively readily stabilized. Therefore, the height of the developer level is stable in the vicinity of the developer discharge outlet 21, thereby making it possible to stabilize the discharge of excess developer.

Also in this example, the developer discharge outlet 21 is positioned at a height substantially equal to or slightly higher than the height of the reference developer level, so that the developer is discharged by overflowing. Thereby, a simple and low-cost developer discharging mechanism can be used to keep the developer of the development tank 11 in the desired amount with high precision. Note that the present invention is not limited to the overflow method. For example, the developer discharge outlet may be provided below the reference developer level, and the developer may be discharged by opening and closing a shutter member. In this case, although a mechanism of opening and closing the shutter member, means of detecting the amount of the developer in the development tank, control means of driving the shutter based on the detection means, and the like are required, the pressure of the developer on the developer discharge outlet can be reduced by providing the flow regulating member, a small amount of developer can be discharged with high precision by opening and closing the shutter member, thereby making it possible to keep the developer of the development tank in the desired amount with high precision.

Variations of Development Apparatus

Next, variations of the development apparatus will be described. Note that, in FIGS. 6(*a*) to 17(*b*), the same components as those in the above-described example (FIGS. 4(*a*) to 5(*d*)) are indicated with the same reference numerals, and will not be described. Different components will be described in detail.

Variation 1

In the above-described example, as illustrated in FIGS. 4(*a*) to 4(*c*), the single flow regulating member 22 is provided in the development apparatus 5. Alternatively, as described in Variation 1 below, a development apparatus 30 can be provided with a plurality of flow regulating members 31, 31, . . . (three in Variation 1).

Figure 6:
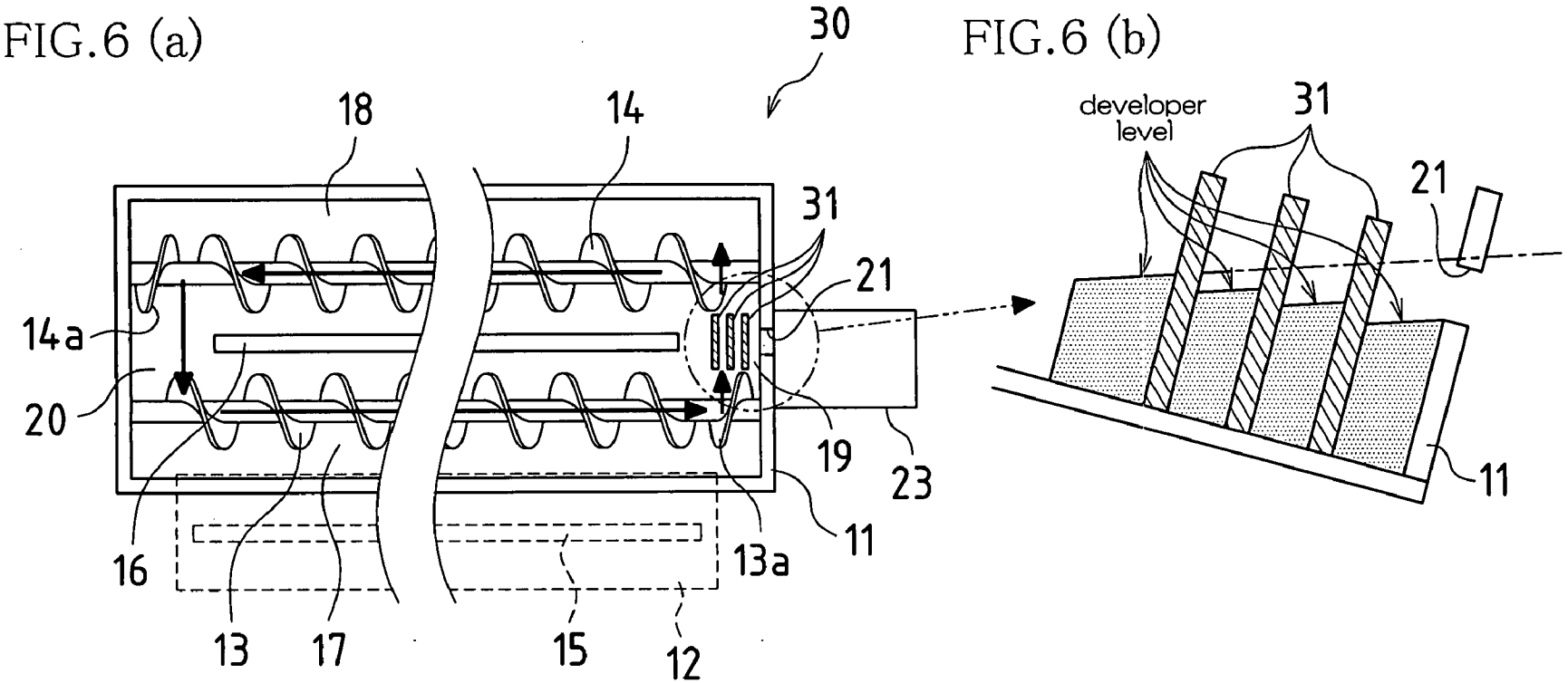
FIGS. 6(*a*) and 6(*b*) are diagrams illustrating Variation 1 of the development apparatus.

FIGS. 6(*a*) and 6(*b*) are diagrams illustrating a development apparatus according to Variation 1. FIG. 6(*a*) is a top view illustrating an internal structure thereof, and FIG. 6(*b*) is a front view illustrating a main portion thereof which is involved in discharge of the developer. As illustrated in FIGS. 6(*a*) and 6(*b*), the development apparatus 30 is provided with the three flow regulating members 31, 31, and 31 which have substantially the same size and are parallel to each other, in the connection portion 19 closer to the developer discharge outlet 21 of the development tank 11. Each flow regulating member 31 is an erected wall-shaped member which extends vertically upward from the bottom plane of the development tank 11 and is provided substantially parallel to the side wall of the development tank 11. A top end of each flow regulating member 31 is positioned higher than a top end of the developer discharge outlet 21. Each flow regulating member 31 has a length in a direction along the side wall of the development tank 11, which is as long as possible within a range in which the flow regulating member 31 does not interfere with the agitating screws 13 and 14.

By providing the flow regulating members 31, 31, . . . in the development apparatus 30 in this manner, preferably, when external disturbance is applied (e.g., the whole image forming apparatus is tilted, or an impact is externally applied), uneven distribution of the developer can be reduced by the flow regulating members 31, 31, . . . , so that a variation in the height of the developer level between the flow regulating member 31 closest to the developer discharge outlet 21, and the side wall of the development tank 11 can be suppressed, as illustrated in FIG. 6(*b*). Also, even during a normal operation, the function of regulating the flow of the developer in the connection portion 19 can be improved, thereby making it possible to effectively suppress a temporary variation in the height of the developer level due to rotation of the agitating screw 13, so that developer can be efficiently discharged.

Variations 2 and 3

Figure 7:
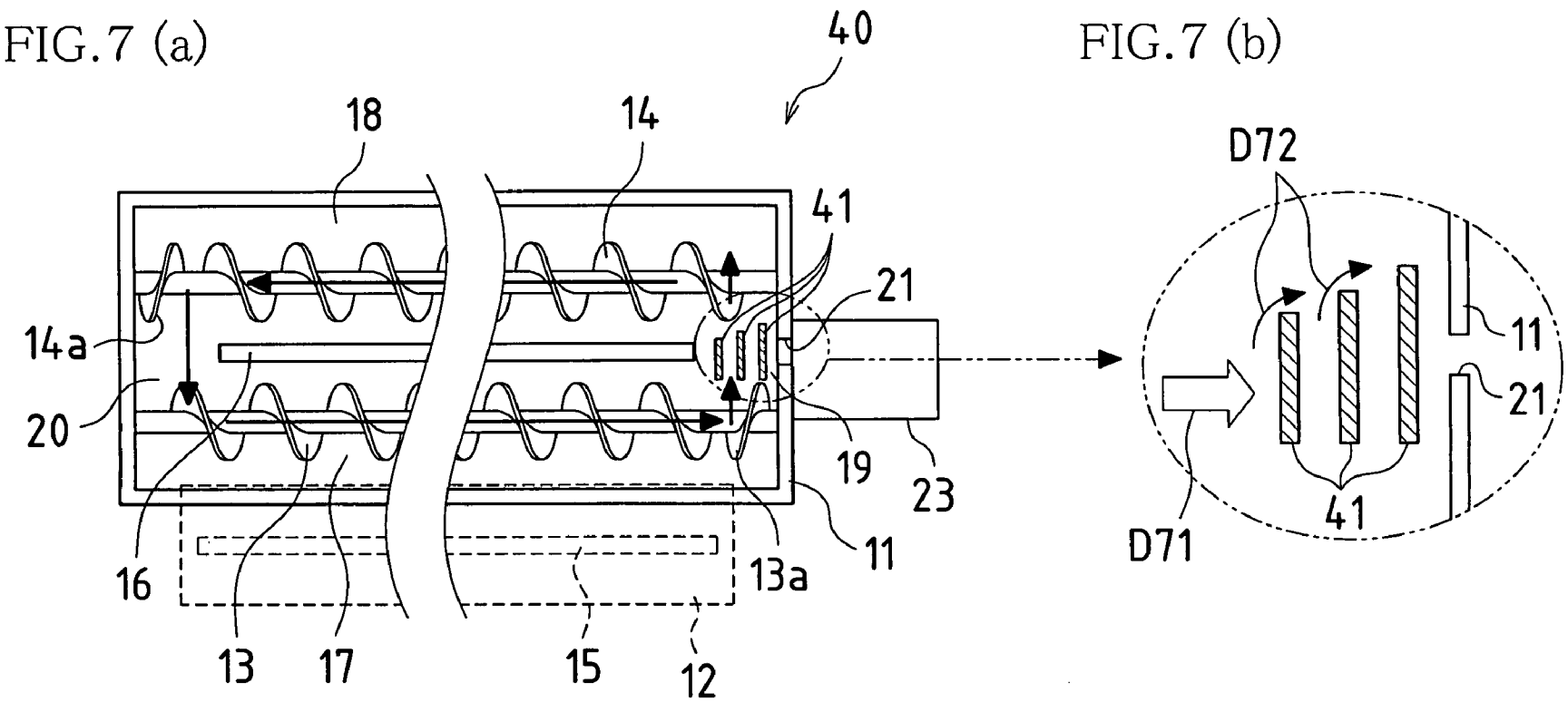
FIGS. 7(*a*) and 7(*b*) are diagrams illustrating Variation 2 of the development apparatus.
Figure 8:
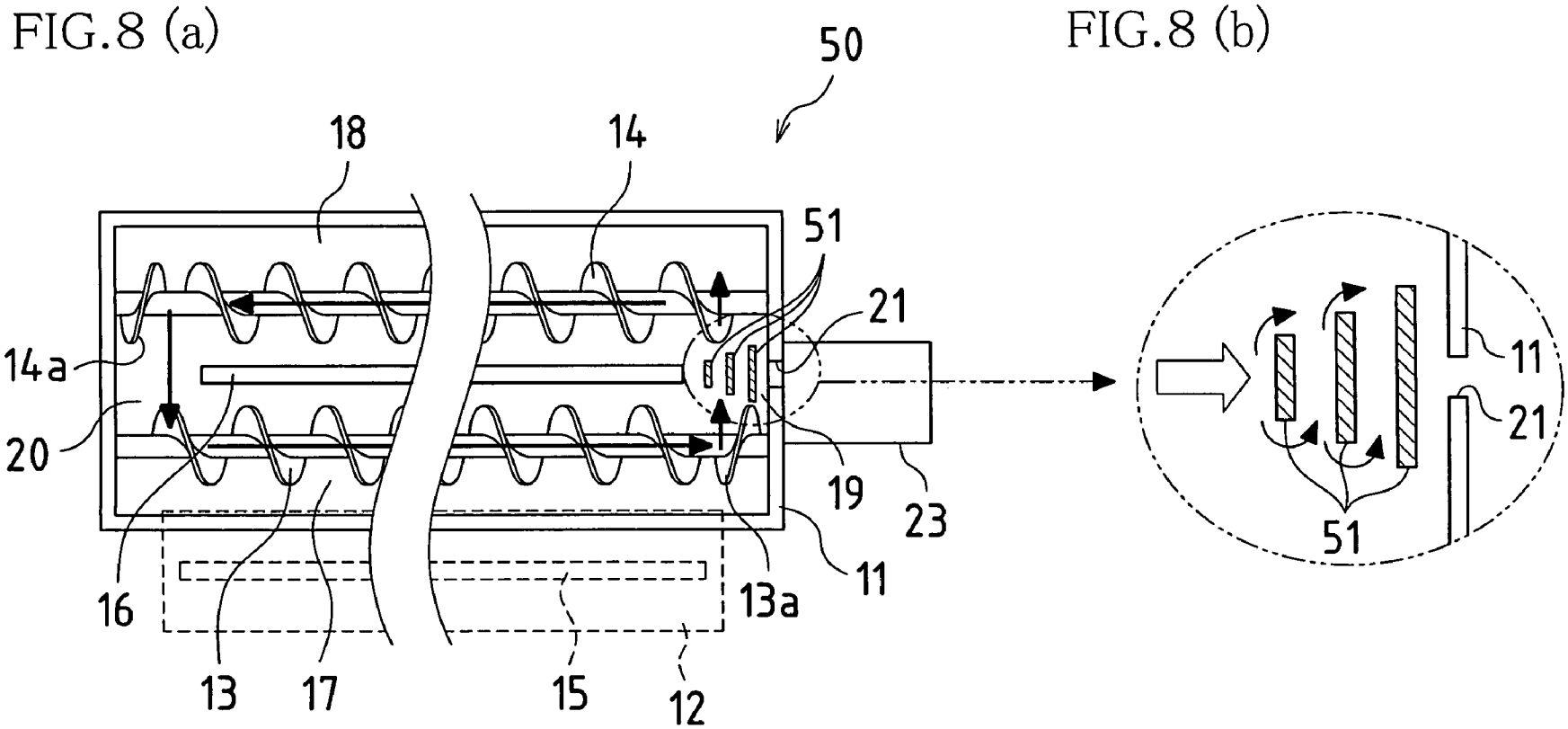
FIGS. 8(*a*) and 8(*b*) are diagrams illustrating Variation 3 of the development apparatus.

In Variation 1 of FIGS. 6(*a*) and 6(*b*), the flow regulating members 31, 31, . . . having substantially the same size are provided in the development tank 11. Alternatively, flow regulating members having different sizes may be provided as described in Variation 2 or 3 below. FIGS. 7(*a*) and 7(*b*) are diagrams illustrating a development apparatus according to Variation 2. FIG. 7(*a*) is a top view illustrating an internal structure thereof, and FIG. 7(*b*) is a top view illustrating a main portion thereof which is involved in discharge of developer. FIGS. 8(*a*) and 8(*b*) are diagrams illustrating a development apparatus according to Variation 3. FIG. 8(*a*) is a top view illustrating an internal structure thereof, and FIG. 8(*b*) is a top view illustrating a main portion thereof which is involved in discharge of the developer.

In the development apparatus 40 of FIGS. 7(*a*) and 7(*b*), three flow regulating members 41, 41, and 41 which have different sizes and are provided parallel to each other, are provided in the connection portion 19 closer to the developer discharge outlet 21 of the development tank 11. The flow regulating member 41 which is provided closer to the developer discharge outlet 21 has a larger length in a direction along the side wall of the development tank 11. The flow regulating members 41 are arranged in the shape of a staircase whose steps are provided at a downstream side in the developer transport direction of the connection portion 19, as viewed from the top. In the development apparatus 50 illustrated in FIGS. 8(*a*) and 8(*b*), a flow regulating member 51 which is provided closer to the developer discharge outlet 21 has a larger length in a direction along the side wall of the development tank 11. The flow regulating members 51 are arranged in the shape of a pyramid, as viewed from the top.

In the case where the flow regulating members 41, 41, . . . of FIGS. 7(*a*) and 7(*b*) are used, when the whole image forming apparatus is tilted or the like, although the developer tends to be biased in a direction indicated with arrow D71 in FIG. 7(*b*), the flow regulating members 41, 41, . . . regulate the developer in a direction indicated with arrows D72 of FIG. 7(*b*). Thereby, it is possible to prevent a large amount of developer from flowing into between the flow regulating member 41 closest to the developer discharge outlet 21, and the side wall of the development tank 11, thereby making it possible to further suppress a variation in the height of the developer level, so that excessive developer discharge can be prevented. When the flow regulating members 51, 51, . . . of FIGS. 8(*a*) and 8(*b*) are used, an operational advantage similar to that of the flow regulating members 41, 41, . . . of FIGS. 7(*a*) and 7(*b*) can be obtained.

Variations 4 and 5

Figure 9:
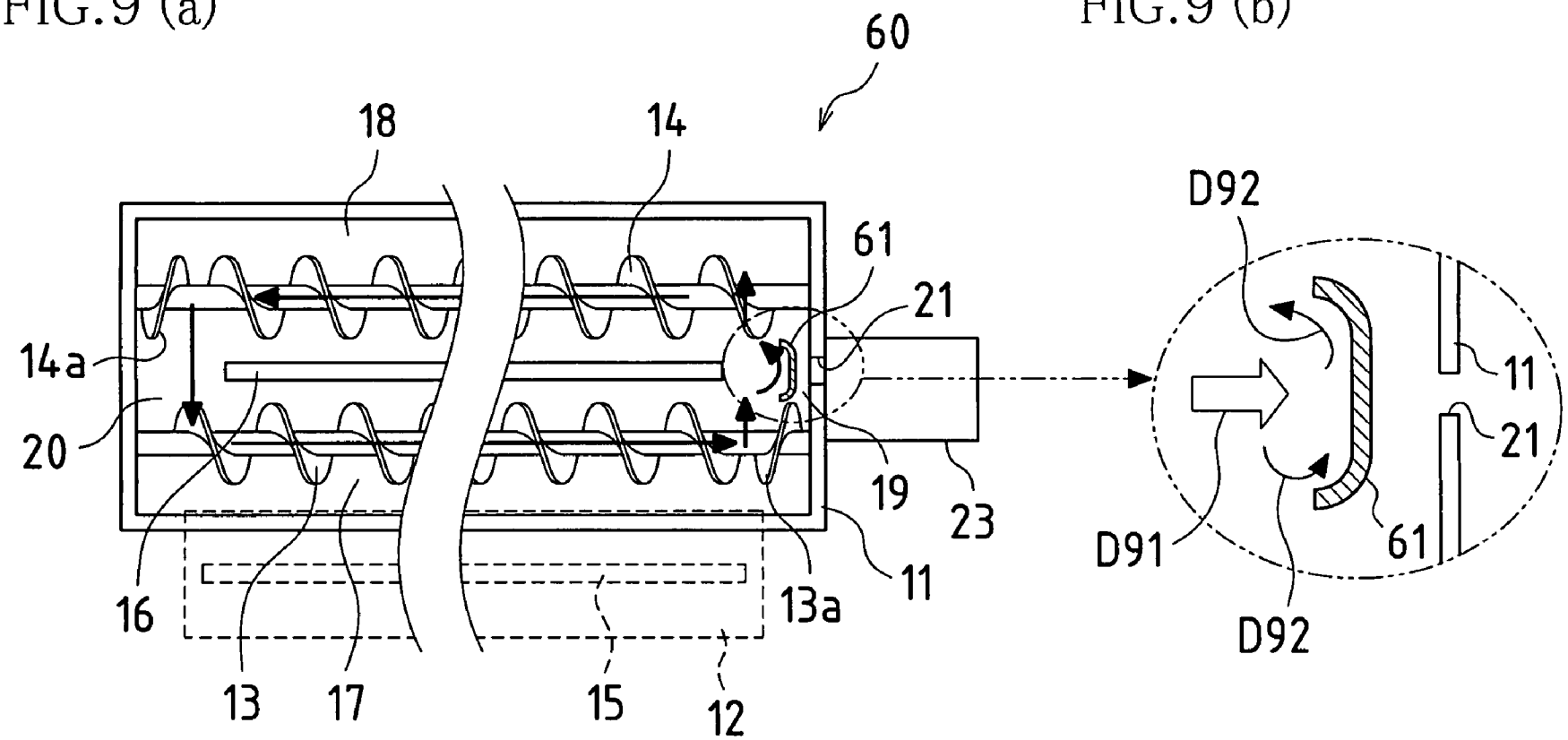
FIGS. 9(*a*) and 9(*b*) are diagrams illustrating Variation 4 of the development apparatus.
Figure 10:
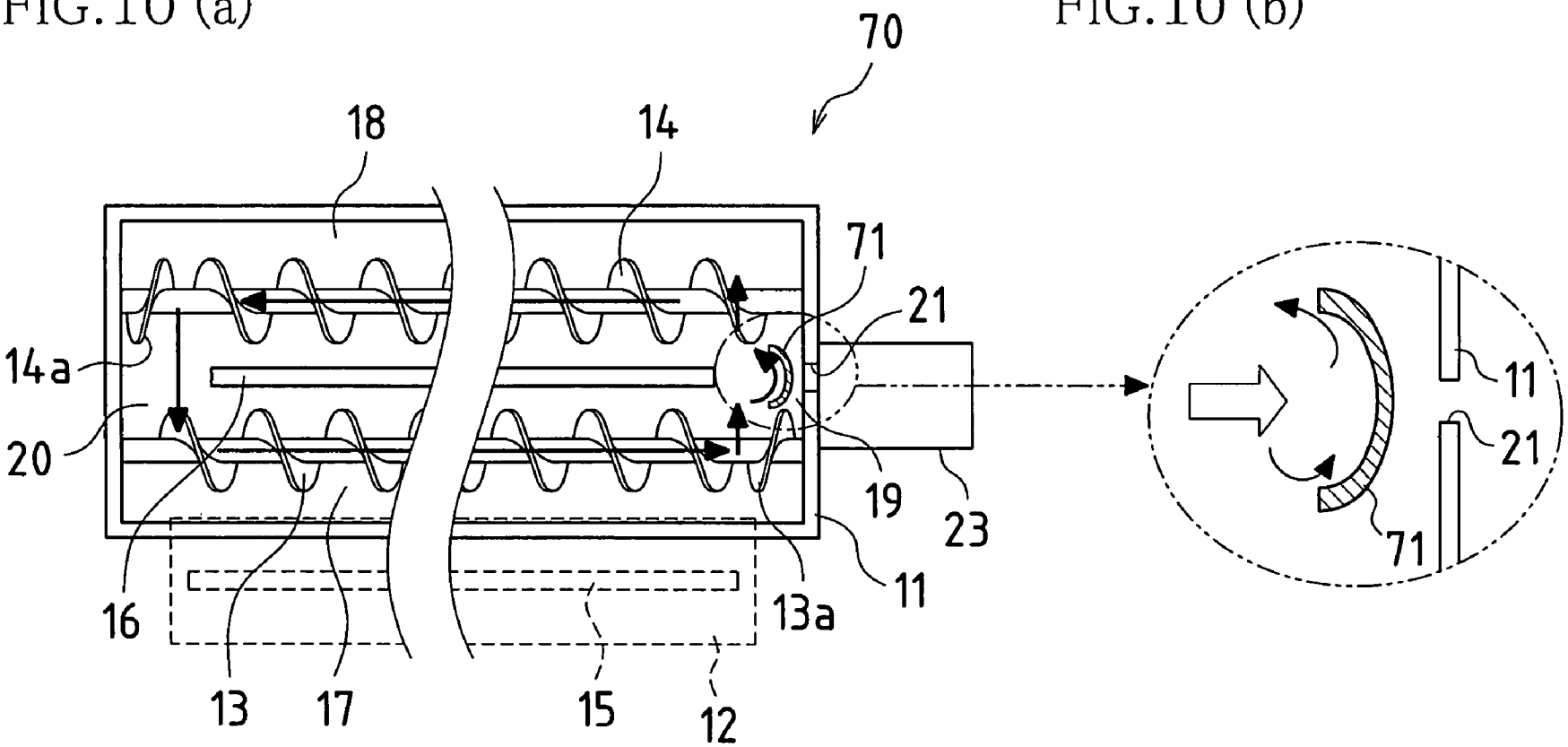
FIGS. 10(*a*) and 10(*b*) are diagrams illustrating Variation 5 of the development apparatus.

Alternatively, a flow regulating member having a shape as described in Variation 4 or 5 below can be provided in the development tank 11. FIGS. 9(*a*) and 9(*b*) are diagrams illustrating a development apparatus according to Variation 4. FIG. 9(*a*) is a top view illustrating an internal structure thereof, and FIG. 9(*b*) is a top view illustrating a main portion thereof which is involved in discharge of the developer. FIGS. 10(*a*) and 10(*b*) are diagrams illustrating a development apparatus according to Variation 5. FIG. 10(*a*) is a top view illustrating an internal structure thereof, and FIG. 10(*b*) is a top view illustrating a main portion thereof which is involved in discharge of the developer.

In the development apparatus 60 of FIGS. 9(*a*) and 9(*b*), a flow regulating member 61 is provided in the connection portion 19 which is closer to the developer discharge outlet 21 of the development tank 11. The flow regulating member 61 has a surface on a side thereof opposite to the developer discharge outlet 21, the surface being curved in the shape of a convex toward the developer discharge outlet 21, as viewed from the top. In the development apparatus 70 of FIGS. 10(*a*) and 10(*b*), a flow regulating member 71 is in the shape of an arc, as viewed from the top.

In the case where the flow regulating member 61 having the shape of FIGS. 9(*a*) and 9(*b*) is used, when the whole image forming apparatus is tilted or the like, although the developer tends to be biased in a direction indicated with arrow D91 in FIG. 9(*b*), the curved portions at both ends of the flow regulating member 61 cause the developer to flow in a direction indicated with arrows D92 of FIG. 9(*b*). Thereby, it is possible to prevent an excessive amount of developer from flowing into between the flow regulating member 61 and the side wall of the development tank 11, thereby making it possible to further suppress a variation in the height of the developer level, so that excessive developer discharge can be prevented. When the flow regulating member 71 of FIGS. 10(*a*) and 10(*b*) is used, an operational advantage similar to that of the flow regulating member 61 of FIGS. 9(*a*) and 9(*b*) can be obtained.

Variation 6

Figure 11:
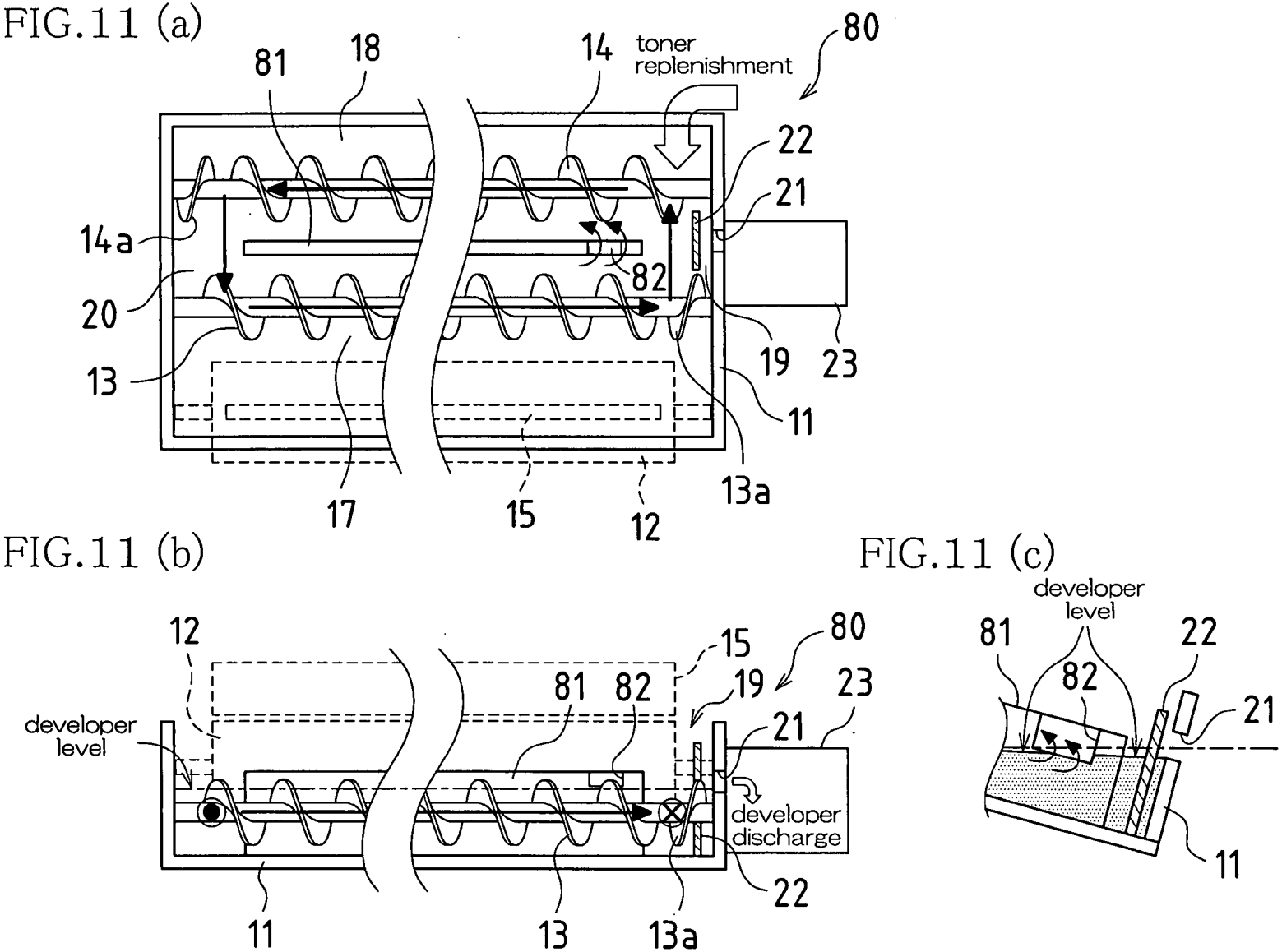
FIGS. 11(*a*) to 11(*c*) are diagrams illustrating Variation 6 of the development apparatus.

Alternatively, a partition wall having a cut away portion as described in Variation 6 below can be provided in the development tank 11. FIGS. 11(*a*) and 11(*b*) are diagrams illustrating a development apparatus according to Variation 6. FIG. 11(*a*) is a top view illustrating an internal structure thereof, FIG. 11(*b*) is a front view thereof, and FIG. 11(*c*) is a diagram illustrating a flow of the developer at the cut away portion.

In the development apparatus 80 of FIGS. 11(*a*) to 11(*c*), a flow regulating member 22 which is similar to that of FIGS. 4(*a*) to 4(*c*) is provided in the development tank 11. A difference from the example of FIGS. 4(*a*) to 4(*c*) is that the partition wall 81 has the cut away portion 82. As illustrated in FIG. 11(*b*), the cut away portion 82, which has a rectangular shape, is provided in an upper portion of an end portion of the partition wall 81, the end portion being closer to the connection portion 19, i.e., closer to the developer discharge outlet 21.

By providing such a cut away portion 82, when the whole image forming apparatus is tilted or the like, a flow of the developer can takes a shortcut by way of the cut away portion 82 as illustrated in FIG. 11(*c*), and the developer can be transported from the first accommodation portion 17 to the second accommodation portion 18 without via the connection portion 19. Thereby, it is possible to prevent an excessive amount of developer from flowing into between the flow regulating member 22 and the side wall of the development tank 11, thereby making it possible to further suppress a variation in the height of the developer level, so that excessive developer discharge can be prevented.

Variation 7

Alternatively, a flow regulating member can be slanted, but not be parallel to the side wall of the development tank 11, as described in Variation 7 below.

Figure 12:
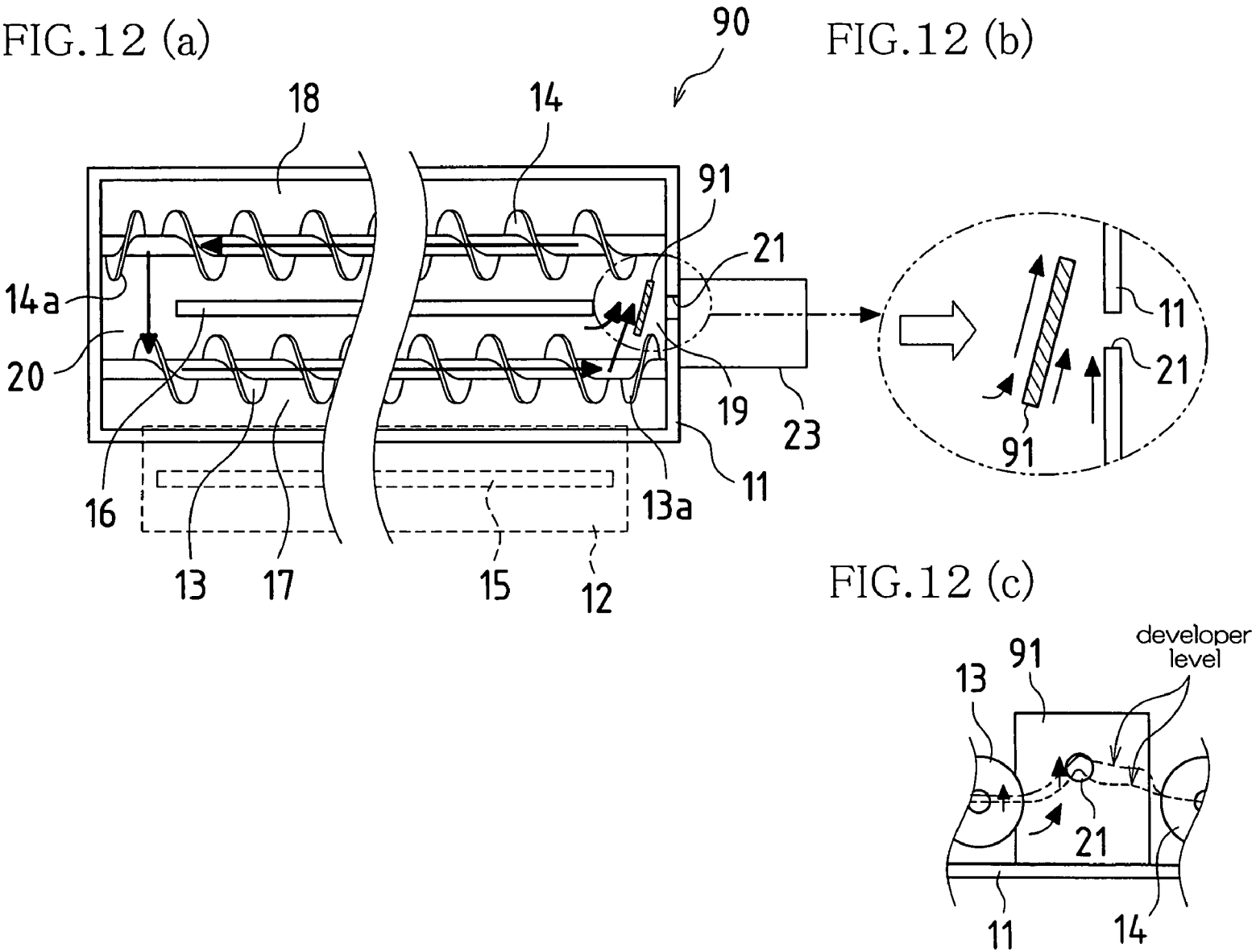
FIGS. 12(*a*) to 12(*c*) are diagrams illustrating Variation 7 of the development apparatus.

FIGS. 12(*a*) to 12(*c*) are diagrams illustrating a development apparatus according to Variation 7. FIG. 12(*a*) is a top view illustrating an internal structure thereof, FIG. 12(*b*) is a top view illustrating a main portion thereof which is involved in discharge of the developer, and FIG. 12(*c*) is a cross-sectional side view illustrating a main portion thereof, indicating a variation in the height of the developer level between the flow regulating member and the side wall of the development tank. In the development apparatus 90 of FIGS. 12(*a*) to 12(*c*), a flow regulating member 91 having a flat shape is provided in the connection portion 19 closer to the developer discharge outlet 21 in the development tank 11. The flow regulating member 91 is not parallel to the side wall of the development tank 11 and is slanted so that a gap between the flow regulating member 91 and the side wall of the development tank 11 is gradually narrowed toward downstream in the developer transport direction. In addition, a lower end of the developer discharge outlet 21 is positioned at a height slightly higher than the height of the reference developer level of the development tank 11.

When the flow regulating member 91 of FIGS. 12(*a*) to 12(*c*) is used, it is more difficult for the developer to flow at a location closer to a downstream side in the developer transport direction between the flow regulating member 91 and the side wall of the development tank 11. Therefore, the height of the reference developer level is higher between the flow regulating member 91 and the side wall of the development tank 11 than in other portions of the development tank 11. In this case, the height of the reference developer level is changed as illustrated with a dashed line in FIG. 12(*c*). As illustrated in FIG. 12(*c*), the difficulty of the developer flow increases with a decrease in the gap between the flow regulating member 91 and the side wall of the development tank 11, so that pressure on the developer increases. As a result, the developer flows while gradually raising the developer level in order to maintain the bulk density thereof. However, when the developer level reaches a certain height at which a pressure for pushing up the developer level to a higher level is equal to a pressure for flowing the developer in the original transport direction, the rise of the developer level stops, so that the developer flows while keeping substantially constant the height of the developer level. By providing the developer discharge outlet 21 so that the lower end thereof is placed at a position where the rise of the developer level stops, and a position in the developer transport direction is placed at the position where the rise of the developer level stops or downstream from the position, when excess developer occurs beyond the desired developer amount, the excess developer is discharged through the developer discharge outlet 21.

When the carrier developer is replenished from the carrier developer replenishment unit 27, the amount of the developer in the development tank 11 is increased. In this case, the height of the developer level is changed as indicated with a dash-dot line in FIG. 12(*c*). As illustrated in FIG. 12(*c*), a variation in the height of the developer level is considerably small in an enter portion between the flow regulating member 91 and the side wall of the development tank 11, i.e., a most upstream portion in the developer transport direction, and in other portions of the development tank 11 than between the flow regulating member 91 and the side wall of the development tank 11. However, as described above, the developer flows while gradually raising the developer level, between the flow regulating member 91 and the side wall of the development tank 11. Therefore, the rising rate of the developer level is higher than in the above-described enter portion and the other portions of the development tank 11. Thereby, the variation in the height of the developer level in the vicinity of the developer discharge outlet 21 is significantly amplified even with respect to a slight change in the amount of the developer. As a result, developer discharge can have good responsiveness.

Here, it is desirable that the developer discharge outlet 21 be provided upstream from a position at which it is most difficult for the developer to flow in a developer transport path between the flow regulating member 91 and the side wall of the development tank 11. This is because an action which propels the developer in the transport direction and an action which raises the developer are subtly balanced and the height of the developer level is likely to be unstable in the region where the developer has difficulty in flowing, i.e., a region where the gap between the flow regulating member 91 and the side wall of the development tank 11 is narrow, and therefore, when the developer discharge outlet 21 is provided in such a position, developer discharge is likely to be unstable. Therefore, the developer discharge outlet 21 is provided at a position which is located upstream from the position at which it is most difficult for the developer to flow between the flow regulating member 91 and the side wall of the development tank 11 and the developer level is stably kept relative high, thereby making it possible to achieve stable developer discharge.

Variation 8

Figure 13:
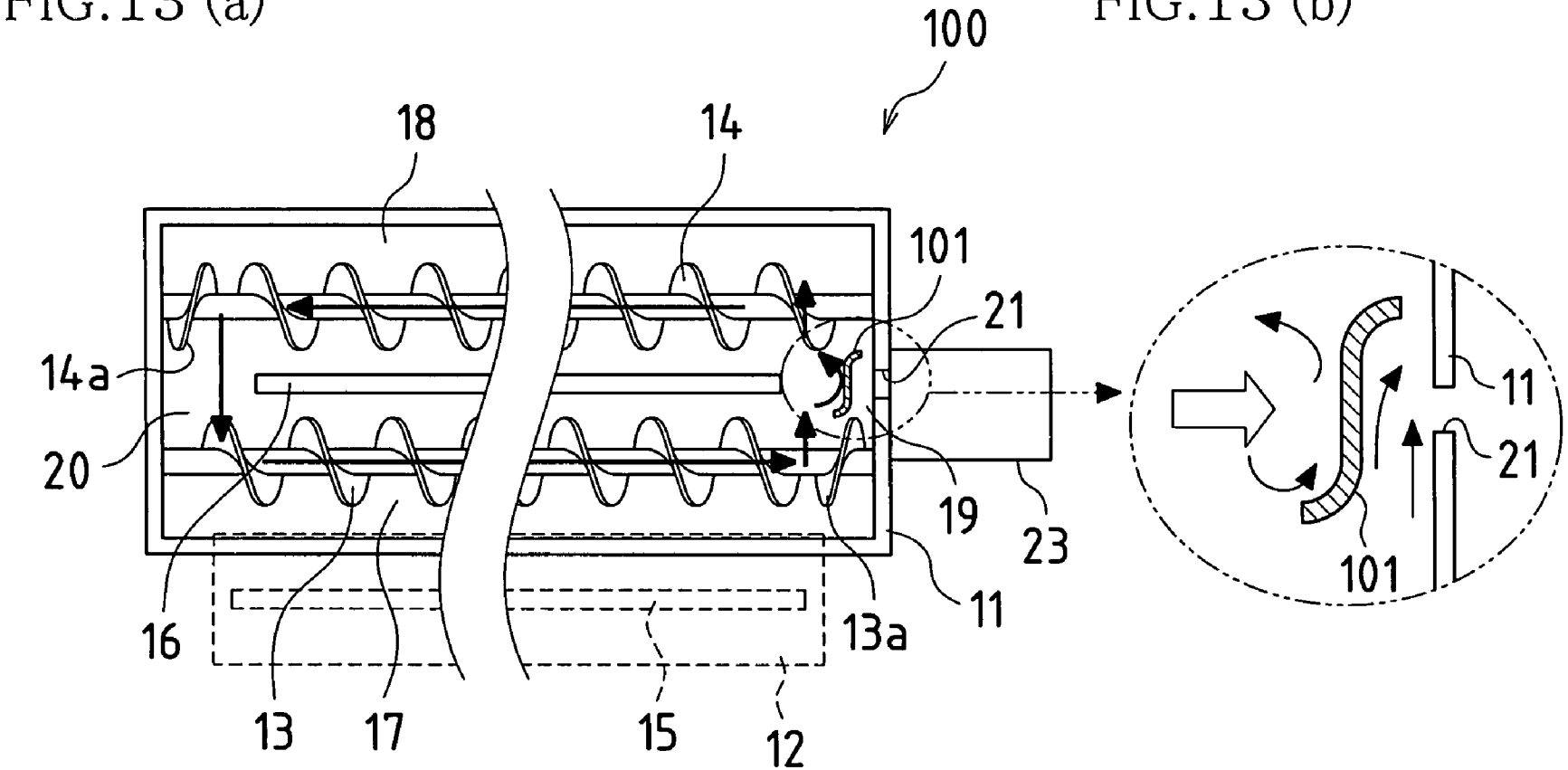
FIGS. 13(*a*) and 13(*b*) are diagrams illustrating Variation 8 of the development apparatus.

In the above-described Variation 7, the flat flow regulating member 91 is slanted with respect to the side wall of the development tank 11. Alternatively, as described in Variation 8 below, a non-flat flow regulating member 101 may be provided. Specifically, in a development apparatus 100 (Variation 8) illustrated in FIGS. 13(*a*) and 13(*b*), a downstream portion in the developer transport direction of the flow regulating member 101 is curved so that a gap between the flow regulating member 101 and the side wall of the development tank 11 is gradually narrowed toward a downstream side in the developer transport direction. When the flow regulating member 101 having the shape of FIGS. 13(*a*) and 13(*b*) is used, an operational advantage similar to that of the flow regulating member 91 of FIGS. 12(*a*) to 12(*c*) are obtained.

Variation 9

Figure 14:
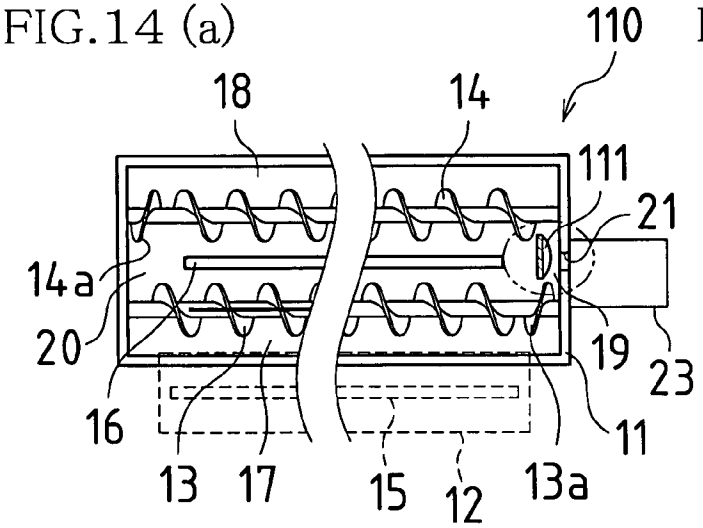
FIGS. 14(*a*) to 14(*d*) are diagrams illustrating Variation 9 of the development apparatus.
Figure 14:
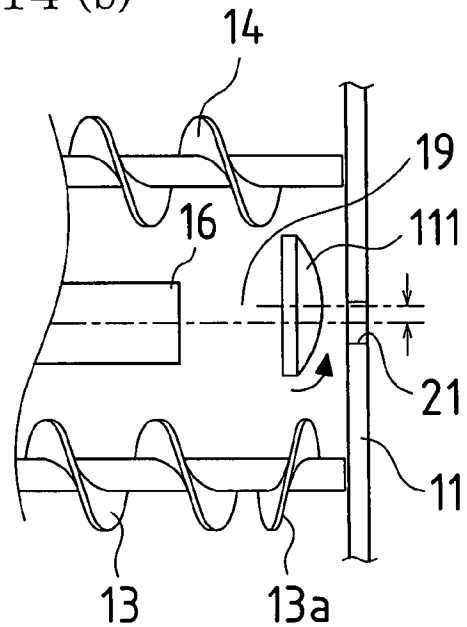
Figure 14:
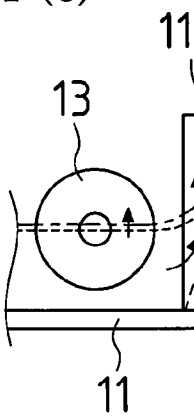
Figure 14:
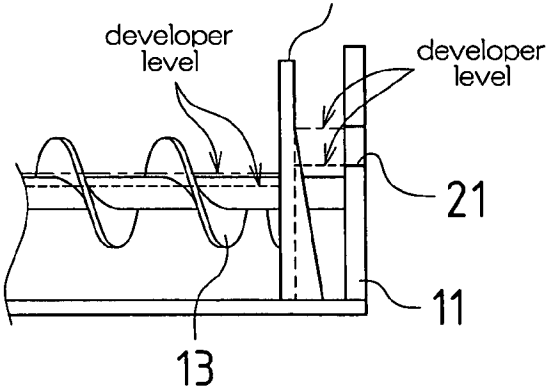
Figure 15:
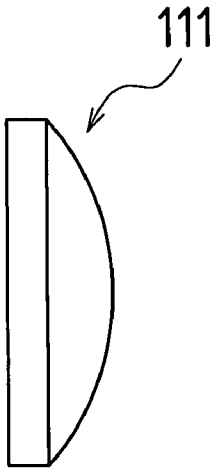
FIGS. 15(*a*) to 15(*c*) are diagrams illustrating a flow regulating member in Variation 9 of the development apparatus.
Figure 15:
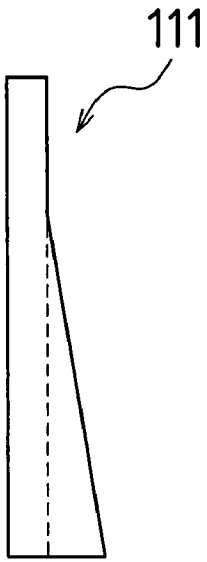
Figure 15:
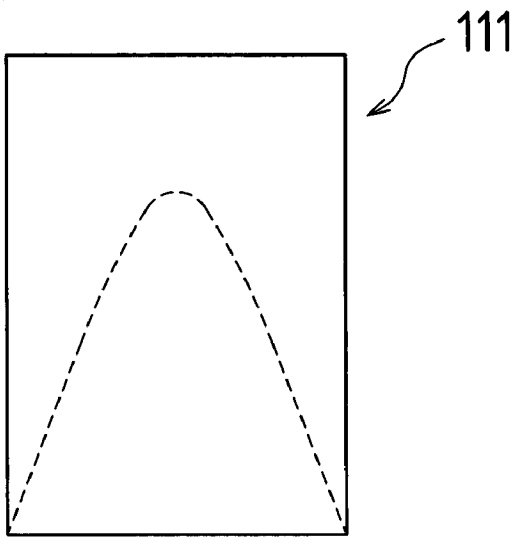

Further, a flow regulating member having a shape illustrated in Variation 9 below can be provided in the development tank 11. FIGS. 14(*a*) to 14(*d*) are diagrams illustrating a development apparatus according to Variation 9. FIG. 14(*a*) is a top view illustrating an internal structure thereof. FIG. 14(*b*) is a top view illustrating a main portion thereof which is involved in discharge of the developer. FIG. 14(*c*) is a cross-sectional side view illustrating a main portion of the development apparatus, indicating a variation of the height of the developer level between the flow regulating member and the side wall of the development tank. FIG. 14(*d*) is a top view of the main portion. FIGS. 15(*a*) to 15(*c*) are diagrams illustrating the flow regulating member in the development apparatus of Variation 9. FIG. 15(*a*) is a top view thereof, FIG. 15(*b*) is a front view thereof, and FIG. 15(*c*) is a side view thereof.

In the development apparatus 110 of FIGS. 14(*a*) to 14(*d*), the flow regulating member 111 is provided in the connection portion 19 which is closer to the developer discharge outlet 21 of the development tank 11. As illustrated in FIGS. 15(*a*) to 15(*c*), a surface of the flow regulating member 111 which is closer to the developer discharge outlet 21 is bulged gradually from a base portion thereof to a middle portion thereof such that an arc protrudes toward the developer discharge outlet 21, and that its degree of bulge (degree of protrusion) is gradually decreasing with approaching the upper portion.

When the flow regulating member 111 having such a shape is used, an operational advantage similar to that of the flow regulating member 91 of FIGS. 12(*a*) to 12(*c*) can be obtained. Specifically, when the flow regulating member 111 of FIGS. 14(*a*) to 14(*d*) and 15(*a*) to 15(*c*) is used, it is difficult for the developer to flow between the flow regulating member 111 and the side wall of the development tank 11, so that the height of the reference developer level becomes higher than other portions of the development tank 11 as indicated with a dashed line in FIGS. 14(*c*) and 14(*d*). When the amount of the developer in the development tank 11 is increased, the height of the developer level is changed as illustrated with a dash-dot line in FIGS. 14(*c*) and 14(*d*). Thereby, the variation in the height of the developer level in the vicinity of the developer discharge outlet 21 is significantly amplified. As a result, developer discharge can have good responsiveness.

Also in this example, as illustrated in FIGS. 14(*a*) to 14(*d*), by providing the developer discharge outlet 21 to an upstream position with respect to a position at which it is most difficult for the developer to flow, stable developer discharge can be carried out. In this case, the rise of the flow regulating member 111 is decreased toward the top, so that when the developer level rises, the developer readily flows in the transport direction. Therefore, the flow regulating member 111 is formed so that a region in which the difficulty of the developer flow is equal becomes larger. Therefore, a likelihood that a state in which the developer level is high is kept stable, is high. Therefore, developer discharge can be more stably performed.

Variations 10 and 11

Figure 16:
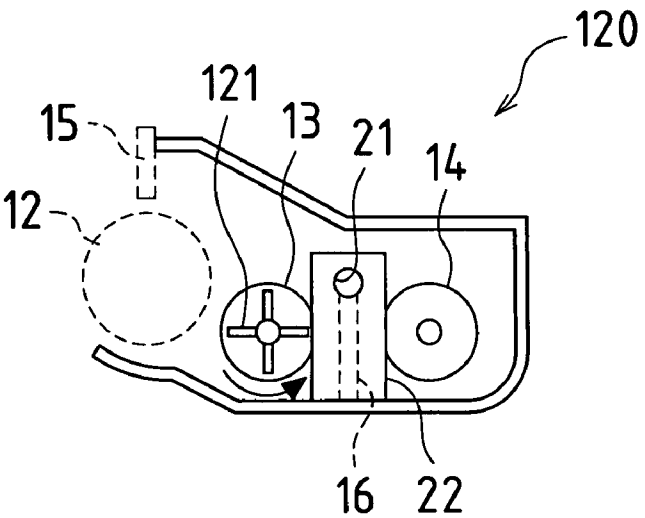
FIGS. 16(*a*) and 16(*b*) are diagrams illustrating Variation 10 of the development apparatus.
Figure 16:
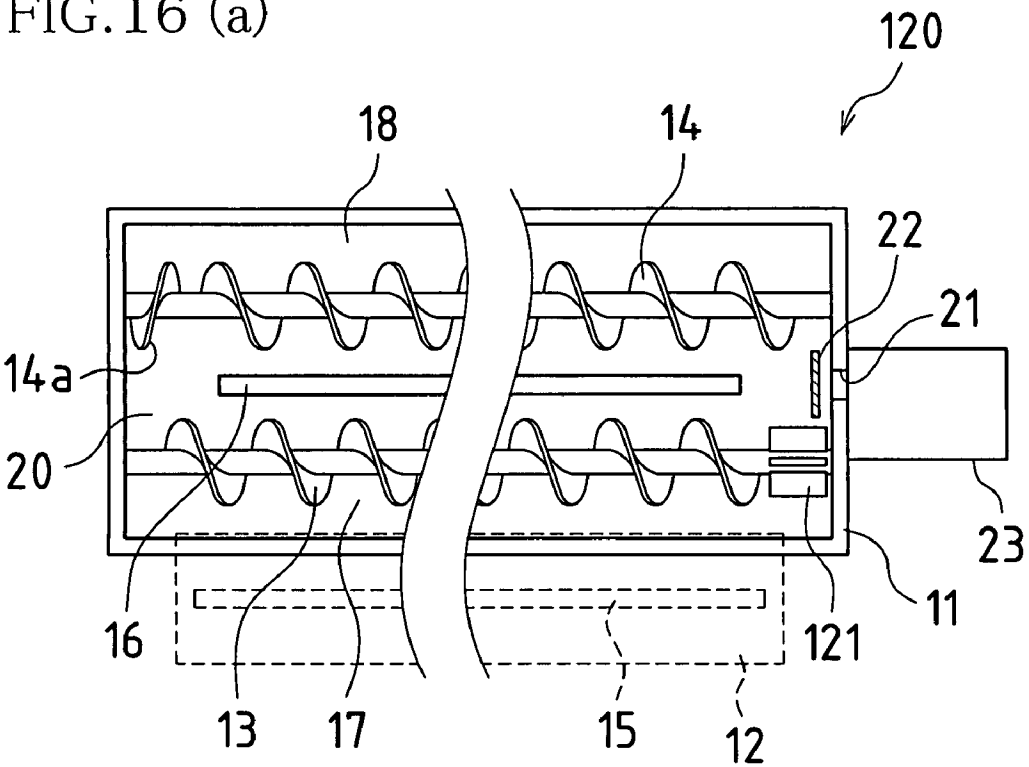
Figure 17:
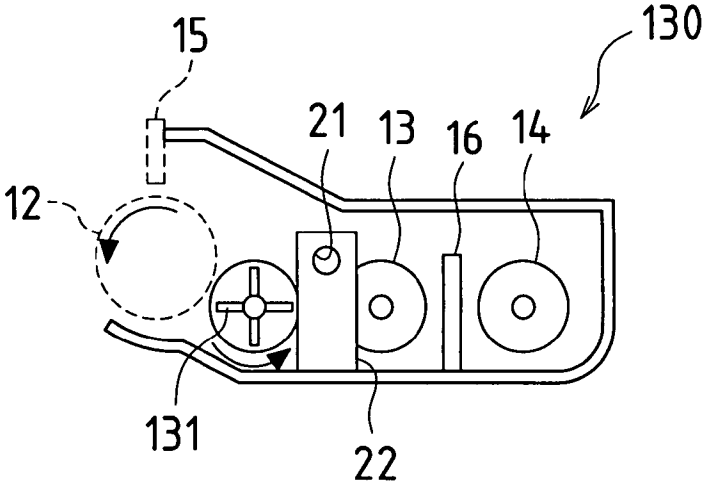
FIGS. 17(*a*) and 17(*b*) are diagrams illustrating Variation 11 of the development apparatus.
Figure 17:
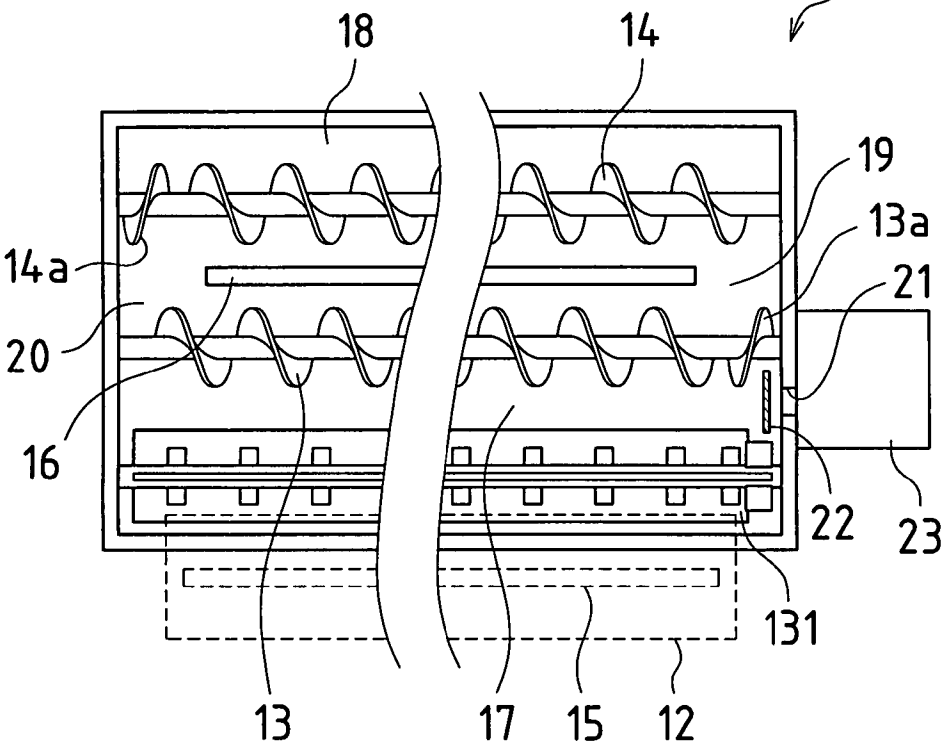

Further, developer discharge responsiveness can be improved by raising the developer level. FIGS. 16(*a*) and 16(*b*) are diagrams illustrating a development apparatus according to Variation 10. FIG. 16(*a*) is a top view illustrating an internal structure thereof. FIG. 16(*b*) is a side view thereof. FIGS. 17(*a*) and 17(*b*) are diagrams illustrating a development apparatus according to Variation 11. FIG. 17(*a*) is a top view illustrating an internal structure thereof FIG. 17(*b*) is a side view thereof.

In the development apparatus 120 of FIGS. 16(*a*) and 16(*b*), a paddle-shaped member 121 is attached to a downstream end portion in the developer transport direction of the agitating screw 13, instead of the reverse pitch blade member 13*a* in the development apparatus 5 of FIGS. 4(*a*) to 4(*c*). By rotation of the paddle-shaped member 121, transport force is applied to the developer in the developer transport direction in the connection portion 19. In addition, the flow regulating member 22 and the developer discharge outlet 21 are provided on the downstream side of the paddle-shaped member 121.

When discharge responsiveness is improved by amplifying the variation in the height of the developer level in the vicinity of the developer discharge outlet 21 as in Variation 7 of FIGS. 12(*a*) to 12(*c*) and the like, it is important to sufficiently and stably apply a developer transport direction component of transport force to the developer flowing in the vicinity of the flow regulating member and the developer discharge outlet 21. In Variation 10, by providing the above-described paddle-shaped member 121, the transport force in the developer transport direction can be positively applied to the developer flowing between the flow regulating member 22 and the side wall of the development tank 11 by rotation of the paddle-shaped member 121. Thereby, developer discharge can be carried out with high responsiveness, so that stabilization of the height of the developer level can be improved. In the development apparatus 130 of FIGS. 17(*a*) and FIG. 17(*b*), a paddle-shaped agitating member 131 is provided on a side closer to the development roller 12 of the agitating screw 13, but not be provided in the agitating screw 13 itself. When such a paddle-shaped agitating member 131 is used, an operational advantage similar to that of the paddle-shaped member 121 of FIGS. 16(*a*) and 16(*b*) can be obtained.

Note that the above-described various examples can be used in combination as appropriate. For example, the flow regulating member 111 of FIGS. 14(*a*) to 14(*d*) can be provided parallel to the side wall of the development tank 11, and therefore, can be used in combination with the structures of FIGS. 6(*a*) to 11(*c*). In this case, more preferably, it is possible to more highly achieve both the suppression of the variation in the height of the developer level when the whole image forming apparatus is tilted or the like and the improvement of the responsiveness of developer discharge.

The present invention can be embodied and practiced in other different forms without departing from the gist and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A development apparatus comprising:

a development container for accommodating developer containing at least toner and carrier;

an agitating-transport member for agitating and transporting the developer in the development container; and a developer carrier provided close to or in contact with an image carrier, for visualizing an electrostatic latent image on the image carrier, wherein the toner and the carrier are externally replenished to the development container, and excess developer in the development container is discharged through a developer discharge outlet to outside of the development container, the development apparatus further comprises a flow regulating member for regulating a flow of the developer, the flow regulating member being provided in the development container, and the flow regulating member is provided facing the developer discharge outlet and extending vertically upward with respect to a bottom plane of the development container.

2. The development apparatus according to claim 1, wherein the developer in the development container is discharged through the developer discharge outlet by overflowing.

3. The development apparatus according to claim 2, wherein the developer discharge outlet is positioned higher than a developer level which is a reference in the development container.

4. The development apparatus according to claim 1, wherein the developer discharge outlet and the flow regulating member are provided downstream in a developer transport direction of the agitating-transport member.

5. The development apparatus according to claim 4, wherein the developer discharge outlet is provided on a side wall of the development container.

6. The development apparatus according to claim 1, wherein a plurality of flow regulating members are provided in the development container.

7. The development apparatus according to claim 6, wherein the flow regulating member which is provided closer to the developer discharge outlet has a larger length.

8. The development apparatus according to claim 1, wherein the flow regulating member is curved so that a surface on a side opposite to the developer discharge outlet of the flow regulating member is in the shape of a convex toward the developer discharge outlet as viewed from the top.

9. The development apparatus according to claim 1, wherein at least two agitating-transport members are provided, and a developer transport path formed by the agitating-transport members is partially separated by a partition wall, and a cut away portion is formed in an upper portion of an end portion closer to the developer discharge outlet of the partition wall.

10. The development apparatus according to claim 9, wherein the developer discharge outlet is positioned facing a connection portion of the developer transport path separated by the partition wall.

11. The development apparatus according to claim 10, wherein the agitating-transport member is provided with a member for applying transport force to the developer in a developer transport direction in the connection portion.

12. The development apparatus according to claim 1, wherein the flow regulating member has a portion such that a gap between the flow regulating member and a side wall of the development container, the developer discharge outlet being provided on the side wall, is gradually narrowed toward downstream in a developer transport direction.

13. The development apparatus according to claim 12, wherein a surface closer to the developer discharge outlet of the flow regulating member protrudes toward the developer discharge outlet, and a degree of the protrusion decreases upward.

14. The development apparatus according to claim 12, wherein the developer discharge outlet is provided upstream from a position at which it is most difficult for the developer to flow in a developer transport path between the side wall of the development container on which the developer discharge outlet is provided, and the flow regulating member.

15. An image forming apparatus comprising the development apparatus according to claim 1.

* * * * *